US006844147B2

(12) United States Patent
Yamashita et al.

(10) Patent No.: US 6,844,147 B2
(45) Date of Patent: Jan. 18, 2005

(54) SILVER HALIDE EMULSION AND METHOD FOR PRODUCING SAME

(75) Inventors: Seiji Yamashita, Kanagawa (JP); Masatoshi Nakanishi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/387,220

(22) Filed: Mar. 13, 2003

(65) Prior Publication Data

US 2003/0232291 A1 Dec. 18, 2003

(30) Foreign Application Priority Data

Mar. 13, 2002 (JP) ..... 2002-069218

(51) Int. Cl.[7] ..... G03C 1/005; G03C 1/494
(52) U.S. Cl. ..... 430/567; 430/569; 430/449
(58) Field of Search ..... 430/567, 569, 430/449

(56) References Cited

U.S. PATENT DOCUMENTS 4,643,966 A * 2/1987 Maskasky ..... 430/567
4,680,256 A * 7/1987 Maskasky et al. ..... 430/567
4,684,607 A * 8/1987 Maskasky ..... 430/567
5,385,818 A * 1/1995 Maskasky ..... 430/567
2003/0104326 A1 6/2003 Ohshima et al.

FOREIGN PATENT DOCUMENTS

JP 58-108533 A 6/1983

* cited by examiner

*Primary Examiner*—Geraldine Letscher
(74) *Attorney, Agent, or Firm*—Sughrue Mion, PLLC

(57) ABSTRACT

The invention provides a silver halide emulsion, comprising: silver halide grains containing silver chloride as a primary component and further containing silver bromide; wherein, when an average value of a silver bromide content of the silver halide grains is represented by Y (mol %), a silver bromide content of at least 68% of the silver halide grains is from 0.82×Y (mol %) to 1.18×Y (mol %). Further, the invention provides a method of producing the silver halide emulsion, comprising the step of reacting at least a silver ion, a chlorine ion and a bromine ion; wherein a growth speed at a time of forming a silver bromine-containing phase in the reaction process is at least 60% of a critical growth speed.

18 Claims, No Drawings

SILVER HALIDE EMULSION AND METHOD FOR PRODUCING SAME

BACKGROUND OF THE INVENTION

1. Field of Invention

The present invention relates to silver halide emulsions and methods for producing same and, particularly, pertains to a silver halide emulsion, which has excellent reciprocity law characteristics, high sensitivity and high contrast, and a method for producing same.

2. Description of the Related Art

As for silver halide emulsions for use in a color photographic paper and the like, a silver halide emulsion which has a high silver chloride content (hereinafter referred to also as "high silver chloride emulsion") has ordinarily been used to satisfy a request for performing rapid processing to enhance productivity. Low sensitivity softening is generally easily caused in these halogen emulsions, which have a high silver chloride content, by high illuminance exposure, such as a laser exposure. Moreover, a fogging density in these halogen emulsions is high. Various techniques have been disclosed to improve these points.

On the other hand, for improving high intensity reciprocity failure of a silver chloride emulsion, a technique for doping iridium is known. However, it is known that the silver chloride emulsion doped with iridium causes latent image sensitization for a short period of time after exposure. For example, JP-B No. 7-34103 discloses providing a local phase which is high in silver bromide and, then doping the thus-provided local phase with iridium to solve the problem of latent image sensitization. The silver halide emulsion prepared in this manner has high sensitivity and high contrast in a relatively high intensity exposure of about 1/100 second and does not cause a problem of latent image sensitization; however, it has come to be apparent that, when it is intended to maintain high sensitivity even for a super high intensity exposure of 1 microsecond which is required by a digital exposure performed by a laser-scanning exposure, a problem occurs, such that it is unlikely to cause a high contrast gradation. U.S. Pat. No. 5,691,119, discloses a method of making a high intensity gradation to have high contrast using a method of preparing an emulsion having a localized phase which is high in a silver bromide content; however, there is a defect that an effect thereof is not sufficient and also performance is not stable in repeated preparation of the emulsion.

U.S. Pat. Nos. 5,726,005 and 5,736,310 discloses that an emulsion which is high in sensitivity and low in high intensity reciprocity failure can be obtained by preparing a silver chloride-rich emulsion which contains a maximum concentration of iodine on a sub-surface thereof. Although such emulsion can certainly can obtain a sensitivity as high as that of the high intensity exposure, it was found that the emulsion provides gradation which is consistently low in contrast, is not appropriate for a digital exposure in which a dynamic range of light amount is limited and, further, provides a high fogging density whereby the emulsion is not appropriate as a material to be used, without further modification, for prints. U.S. Pat. Nos. 5,728,516, 5,547,827 and 5,605,789; and JP-A No. 8-234354 disclose methods for reducing the fogging density of an emulsion which contains a maximum concentration of iodine on a sub-surface thereof; however, none of these methods exhibites an effect sufficient to be used as a material for prints.

JP-A Nos. 58-95736, 58-108533, 60-222844, 60-222845, 62-253143, 62-253144, 62-253166, 62-254139, 63-46440, 63-46441 and 63-89840; and U.S. Pat. Nos. 4,820,624, 4,865,962, 5,399,475 and 5,284,743 disclose that high sensitivity can be obtained by localize-adding phases of varied states, each of which has a high silver bromide content, into high silver chloride emulsions, in various forms.

As described above, providing a high bromide-containing phase to grains has been disclosed for the purpose of improving reciprocity law characteristics, and obtaining high sensitivity and high contrast of the high silver chloride emulsion. However, in methods so far disclosed, a distribution among grains of a bromide content and an uneven distribution of a high bromide-containing phase occur along with recrystallization and, as a result, it was difficult to obtain photographic characteristics with an emulsion having high sensitivity and high contrast or to prepare an emulsion which has excellent reciprocity law characteristics and does not cause the latent image sensitization.

SUMMARY OF THE INVENTION

An object of the present invention is to provide a silver halide emulsion which has excellent reciprocity law characteristics and sensitometric characteristics such as high sensitivity and high contrast and a method for producing the silver halide emulsion.

In order to achieve the above-described object, the present inventors have conducted an extensive study and, as a result, have found that the stated object is achieved by a product and a method as described below. Namely, the present invention discloses a silver halide emulsion, comprising: silver halide grains containing silver chloride as a primary component and further containing silver bromide; wherein, when an average value of a silver bromide content of the silver halide grains is represented by Y (mol %), a silver bromide content of at least 68% of the silver halide grains is from 0.82×Y (mol %) to 1.18×Y (mol %).

Further, the invention discloses the silver halide emulsion, wherein a grain size distribution is no more than 20%.

Further, the invention discloses the silver halide emulsion, wherein a silver chloride content is at least 95 mol %.

Further, the invention discloses the silver halide emulsion, comprising a silver bromide-containing phase, in which an average Br content is at least 18 mol %

Further, the invention discloses the silver halide emulsion, wherein the silver bromide-containing phase includes a layer-shaped structure having a thickness of from 0.005 $\mu$m to 0.04 $\mu$m.

Further, the invention discloses the silver halide emulsion, wherein an average Br content of the silver bromide-containing phase is from 20 mol % to 32 mol %.

Further, the invention discloses the silver halide emulsion, wherein at least 50% of a projected area of the grains is trisoctahedral.

Further, the invention discloses the silver halide emulsion, wherein at least 50% of a projected area of the grains before the silver bromide-containing phase is formed is trisoctahedral.

Further, the invention discloses the silver halide emulsion, comprise silver iodide in the range of from 0.05 mol % to 0.4 mol %.

Further, the invention discloses a method of producing a silver halide emulsion, comprising the step of reacting at least a silver ion, a chlorine ion and a bromine ion; wherein a growth speed at a time of forming the silver bromine-containing phase in the reaction process is at least 60% of a critical growth speed.

Further, the invention discloses the method of producing the silver halide emulsion, wherein the growth speed is at least 70% of the critical growth speed.

Further, the invention discloses the method of producing the silver halide, wherein a temperature at the time of forming the silver bromide-containing phase is no more than 38° C.

DETAILED DESCRIPTION OF THE PREFERRED EMBODIMENTS

Hereinafter, the present invention will be described in detail.

A silver halide emulsion, comprising: silver halide grains containing silver chloride as a primary component and further containing silver bromide; wherein, when an average value of a silver bromide content of the silver halide grains is represented by Y (mol %), a silver bromide content of at least 68% of the silver halide grains is from 0.82×Y (mol %) to 1.18×Y (mol %) (hereinafter referred to also as "specified silver halide grains").

As for the silver halide emulsion, when the average of the silver bromide content in the silver halide grains is represented by Y (mol %), the silver bromide content of at least 68% of the silver halide grains is preferably from 0.85×Y (mol %) to 1.15×Y (mol %), the silver bromide content of at least 68% of the silver halide grains is more preferably from 0.90×Y (mol %) to 1.1×Y (mol %).

A grain form of the specified silver halide grains in the silver halide emulsion according to the invention is not particularly limited; however, it is preferable that the specified silver halide grains comprise cubic grains substantially having a {100} face, tetradechedral crystal grains (these grains may have a round vertex to have a higher order faces), octahedral crystal grains, or tabular grains having an aspect ratio of 2 or more in which a primary face comprises a {100} face or {111} face. The term "aspect ratio" as used herein is intended to include a value obtained by dividing a diameter of a circle corresponding to a projected area by thickness of a grain. According to the invention, the cubic grains or tetradechedral grains are more preferable. Further, as described below, in the silver halide emulsion of the invention, trisoctahedral grains are also preferable.

As for the silver halide emulsion of the invention, an emulsion containing the specified silver halide grains comprising silver chloride as a primary component and further comprising from silver iodochloride to silver bromochloride (hereinafter referred to also as "high silver chloride emulsion" in some cases) is used. As for the silver halide emulsion comprising silver chloride as a primary component according to the invention, mentioned is an emulsion containing silver halide grains having a silver chloride content of from 89 mol % to 99.7 mol % whereupon, from the standpoint of rapid processing properties, the silver chloride content is preferably from 93 mol % to 99.5 mol % and more preferably from 95 mol % to 98.5 mol %.

Further, it is preferable that the silver halide emulsion (high silver chloride emulsion) according to the invention may contain silver halide grains having a silver bromide content of from 1 mol % to 5 mol %. When the silver bromide content is from 1 mol % to 5 mol %, a silver bromide-containing phase having a content of at least 20 mol % to be described below can be formed without any problem. Further, characteristics (rapid processing speed or reduced replenishing resistance) of silver chloride are not damaged at development/fixing or the like whereupon, since lattice misfit to be generated by a gap of a halogen composition with an interface of a core portion is small, reduction of sensitivity in terms of an inner sensitivity/lowering of contrast, or delay of development does not occur.

Further, in the high silver chloride emulsion according to the invention, the silver iodide content is preferably from 0.05 mol % to 1 mol % and, owing to high sensitivity and high contrast by a high intensity exposure, more preferably from 0.05 mol % to 0.5 mol % and still more preferably from 0.1 mol % to 0.4 mol %. Silver iodide is preferably contained in host grains in a state before forming a silver bromide-containing phase in the range of from 0.05 mol % to 0.4 mol %.

The specified silver halide grains in the silver halide emulsion of the invention preferably contain at least one of the silver bromide-containing phase and silver iodide-containing phase. The terms "silver bromide-containing phase" and "silver iodide-containing phase" as used herein are intended to each include a portion in which a content of a halide per grain is high and, in this occasion, sites in which a concentration of each of silver bromide and silver iodide is high. Halogen compositions in the silver bromide- or silver iodide-containing phase and the vicinity thereof may be changed either continuously or steeply. The silver bromide- or silver iodide-containing phase may be formed such that it has an expanse of a nearly consistent density or an expanse-less maximum point of density in an arbitrary portion in a grain.

A localized silver bromide content of the silver bromide-containing phase is preferably at least 18 mol % and more preferably from 20 mol % to 32 mol %, whereas a localized silver iodide content of the silver iodide-containing phase is preferably at least 0.2 mol %, more preferably from 0.5 mol % to 8 mol % and most preferably from 1 mol % to 5 mol %. The silver bromide- or silver iodide-containing phase may be present in a plurality of numbers in a grain whereupon silver bromide contents or silver iodide contents thereof may be different from one another.

In the silver halide emulsion of the invention, it is preferable that the silver chloride content is at least 95 mol % and the localized silver bromide content in the silver bromide-containing phase is at least 18 mol %.

In the silver halide grains according to the invention, in regard to a distribution of a Br content among grains, when the Br content against Ag in each grain is measured by a method as described below, an average value of Br contents is represented by Y (mol %) and a standard deviation of the Br contents is represented by σ (mol %), σ/Y is preferably 0.18 or less, more preferably 0.15 or less and still more preferably 0.10 or less.

The distribution of the Br contents among grains is considered to be a normal distribution and, when the distribution of the Br contents among grains complies with the normal distribution, the Br content against Ag of the silver halide grains of 68% comes to be from (1−σ/Y)×Y (mol %) to (1+σ/Y)×Y (mol %) whereupon, when σ/Y is 0.18, at least 68% of the silver halide grains become such silver halide grains as have a silver bromide content of from 0.82×Y (mol %) to 1.18×Y (mol %) and, further, when σ/Y is 0.15, a silver bromide content of at least 68% of the silver halide grains is from 0.85×Y (mol %) to 1.15×Y (mol %) and, still further, when σ/Y is 0.10, a silver bromide content of at least 68% of the silver halide grains is from 0.90×Y (mol %) to 1.10×Y (mol %).

According to the present invention, the Br distribution of the silver halide grains among grains is measured by a method described below.

The emulsion comprising silver halide grains is centrifuged to remove an excess amount of gelatin and, then, dispersed again by water and, thereafter, placed on a mesh made of copper with a supporting film thereon. A mol ratio of Br against Ag per grain is measured by an analytical electron microscopy or an X-ray microanalysis.

The ratio of Br against Ag can be calculated by previously constructing as a calibration curve a ratio between Ag intensity and Br intensity obtained by treating silver halide grains having a known mol ratio of Br against Ag in a same manner as in procedures described above and, then, using the calibration curve on the basis of a ratio between Ag intensity and B intensity of object grains.

It is preferable that the silver bromide- or silver iodide-containing phase of the silver halide emulsion of the invention is formed in a layer state such that it wraps around each grain. As a preferable state, the silver bromide-containing phase is formed in a layer state such that it wraps around each grain has a uniform concentration distribution in a direction of gyration of the grain in each phase. However, for example, when the silver bromide-containing phase is formed in a layer state such that the silver bromide-containing phase wraps around the grain in a vicinity of a surface of the grain, a concentration of silver bromide at a corner or an edge of the grain is sometimes different from that on a primary surface whereupon such difference is preferably small.

The silver bromide-containing phase of the silver halide emulsion of the invention is, from the standpoint of enhancing a local concentration, preferably constituted by a silver amount of from 3% to 4% of a grain volume and more preferably constituted by a silver amount of from 10% to 30% thereof. As a result, an average Br content in the silver bromide-containing phase is preferably from 18 mol % to 40 mol % and, particularly preferably from 20 mol % to 32 mol %.

When the average Br content of the localized phase is from 18 mol % to 40 mol %, improvement of high intensity reciprocity law failure and improvement of latent image sensitization is sufficiently attained, thereby allowing to obtain such photographic characteristics as high contrast.

Thickness of the silver bromide-containing phase of the invention is preferably from 0.005 μm to 0.04 μm and more preferably from 0.01 μm to 0.03 μm. When the thickness of the silver bromide-containing phase is from 0.005 μm to 0.04 μm, the phase is stable and is not recrystallized and, also, the local concentration of the silver bromide-containing phase is elevated to a favorable level.

It is preferable that, in the silver halide emulsion of the invention, the silver bromide-containing phase has a layer structure and the thickness thereof is from 0.005 μm to 0.04 μm and, further, the average Br content is from 20 mol % to 32 mol %.

The silver halide emulsion of the invention may comprise both the silver bromide-containing phase and the silver iodide-containing phase. The silver bromide-containing phase may contain silver iodide and, in an adverse manner, the silver iodide-containing phase may contain silver bromide.

Incorporation of a bromide ion or an iodide ion into the silver halide emulsion of the invention for the purpose of allowing silver bromide or silver iodide to be contained therein may be performed by adding a solution of bromide salt or iodide salt alone or adding a silver salt solution and a high chloride salt solution together with such bromide salt or iodide salt solution. In the latter case, the bromide salt or iodide salt solution and the high chloride salt solution may separately be added, or a mixed solution of the bromide salt or the iodide salt and the high chloride salt may be added. The bromide salt or the iodide salt is added in a form of a dissoluble salt such as an alkali or alkaline earth bromide salt or iodide salt. Alternatively, such incorporation can be performed by splitting an organic molecule described in U.S. Pat. No. 5,389,508 into either a bromide ion or an iodide ion. Further, as another bromide or iodide ion source, fine silver bromide grains or fine silver iodide grains may be employed.

An addition of the bromide salt or iodide salt solution may be performed by being concentrated in a period of time of forming grains or by consuming a fixed period of time. A position of incorporation of the iodide ion into the high chloride emulsion is limited from the standpoint of obtaining a highly-sensitive low-fogging emulsion. As the iodide ion is incorporated deeper inside an emulsion grain, an increase of sensitivity becomes smaller. Therefore, such addition of the iodide salt solution is performed preferably from a site more outside than 50% of a grain volume and more preferably from a sit more outside than 70% of the grain volume. Further, the addition of the iodide salt solution is terminated preferably at a site more inside than 98% of the grain volume and more preferably at a site more inside than 96% of the grain volume. By allowing the addition of the iodide salt solution to be terminated at a site a little inside the grain surface, the highly-sensitive low-fogging emulsion can be obtained. On the other hand, addition of the bromide salt solution is performed preferably from a sit more outside than 50% of the grain volume and more preferably from a site more outside than 70% of the grain volume.

In order to form the silver bromide-containing phase according to the invention, the silver bromide-containing phase is allowed to be grown by setting a growth speed at the time of forming the silver bromide-containing phase as the growth speed of preferably 60% or more of a critical growth speed, more preferably from 70% to 98% of the critical growth speed and particularly preferably from 80% to 95% of the critical growth speed.

The critical growth speed can be determined such that, while a supply speed each of a silver ion and a halogen ion is increased, an addition speed which allows re-nucleation to occur is set as 100%. When a grain size is small and a ratio of the silver bromide-containing phase against entire grains is high, the critical growth speed varies along with growth of the silver bromide-containing phase. In such case, the growth speed of the silver bromide-containing phase is always held at a fixed rate against the critical growth speed by means of, for example, a flow rate acceleration method.

At the time of forming the silver bromide-containing phase of the silver halide emulsion of the invention, a growth temperature is set preferably at 40° C. or less, more preferably at from 1° C. to 38° C. and particularly preferably from 20° C. to 33° C.

The present inventors have conducted an intensive study and, as a result, have found that, in order to prepare the silver halide grains in which at least 68% of the silver halide grains is from 0.82×Y (mol %) to 1.18×Y (mol %) on condition that an average value of the silver halide grains is set as Y (mol %) it is important that the silver bromide-containing phase is formed at a growth speed of 60% or more of the critical growth speed. It is more preferable that the silver bromide-containing phase is formed at a growth speed of 80% or more and at a temperature as low as no more than 38° C.

The present inventors have conducted an intensive study and, as a result, have found that grains before forming the silver bromide-containing phase are preferably trisoctahedral. When the silver bromide-containing phase is formed on such trisoctahedral grain, Br distribution among grains becomes small and such photographic characteristics as high sensitivity and a high contrast can be obtained. This is because, since a uniform Br phase can be formed in a layer state, localization of the silver halide-containing phase in a corner or edge portion does not occur.

In the silver halide grains of the invention, it is preferable that at least 50% of a projected area of the grains before the silver bromide-containing phase is formed is trisoctahedral.

A distribution of a bromide or iodide ion concentration in a direction of depth inside the grain can be measured by using an etching/TOF-SIMS (Time of Flight-Secondary Ion Mass Spectrometry) method, for example, by using TRIFTII Type TOF-SIMS (trade name; manufactured by Phi Evans Co.). The TOF-SIMS method is specifically described in "Surface Analytical Techniques Selection, Secondary Ion Mass Spectrometry" edited by The Surface Science Society of Japan, published by Maruzen (1999). When emulsion grains are analyzed by using the etching/TOF-SIMS method, even after the addition of the iodide salt solution in the inside of the grain is terminated, it is analyzed that the iodide ion is oozed in a direction of the grain surface. In the emulsion of the invention, the iodide ion has a concentration maximum by the etching/TOF-SIMS method and the concentration of the iodide ion is preferably diminished toward the inside of the grain while the bromide ion preferably has a center of gravity of a distribution thereof further inside the grain than the iodide ion and is also preferable to have a concentration maximum further inside the grain. A localized concentration of silver bromide can be measured even by an X-ray diffraction method, so long as an amount of the silver bromide to be contained is high to some extent.

A sphere-corresponding diameter herein used is expressed by a diameter of a sphere having a volume corresponding to that of a grain. Since it is necessary to construct an extremely precise grain structure in the silver halide emulsion of the invention, it is preferable that the silver halide emulsion of the invention comprises grains in which a grain size distribution is mono-disperse. A fluctuation coefficient of the sphere-corresponding diameter of each of the grains of the invention is preferably no more than 20%, more preferably no more than 15% or less and most preferably no more than 12%. The variation coefficient of the sphere-corresponding diameter is expressed by percentage of a standard deviation of the sphere-corresponding diameter of each grain to an average sphere-corresponding diameter. On this occasion, for the purpose of attaining wide latitude, it is favorably performed that such mono-disperse emulsions as described above are blended to be used in one layer or each separately used in respective layers in a laminated state.

The sphere-corresponding diameter of silver halide grains contained in the silver halide emulsion of the invention is preferably 0.8 $\mu$m or less, more preferably 0.5 $\mu$m or less and most preferably 0.4 $\mu$m or less. A grain having a sphere-corresponding diameter of 0.6 $\mu$m corresponds to a cubic grain having a side length of about 0.48 $\mu$m and, in a same manner, a grain having a sphere-corresponding diameter of 0.5 $\mu$m corresponds to a cubic grain having a side length of about 0.4 $\mu$m and, further in a same manner, a grain having a sphere-corresponding diameter of 0.4 $\mu$m corresponds to a cubic grain having a side length of about 0.32 $\mu$m.

The silver halide emulsion of the invention may comprise other silver halide grains than the silver halide grains that is specifically defined in the invention (namely, specified silver halide grains). However, in the silver halide emulsion defined in the invention, it is necessary that at least 68% of the silver halide grains are the specified silver halide grains defined in the invention; further, at least 80% thereof preferably comprise the specified silver halide grains, and more preferably, at least 90% thereof comprise the specified silver halide grains.

The specified silver halide grains in the silver halide emulsion of the invention preferably contain iridium (Ir). As for an iridium compound, a hexa-coordinated complex of iridium as a center metal having 6 ligands is preferable for the purpose of being uniformly incorporated in silver halide crystal. As for one preferable state of iridium to be employed in the invention, the hexa-coordinated complex of Ir as a center metal having ligands which are Cl, Br or I is preferable whereupon the hexa-coordinated complex of Ir as a center metal having 6 ligands which are all Cl, Br or I is preferable. In this occasion, Cl, Br and I may be present in a mixed state in the hexa-coordinated complex. In order to obtain gradation of high contrast by a high intensity exposure, it is particularly preferable that the hexa-coordinated complex of Ir as a center metal having ligands which are Cl, Br or I is contained in the silver bromide-containing phase.

Specific examples of such hexa-coordinated complexes of Ir as a center metal having 6 ligands which are all Cl, Br or I are given below to illustrate iridium according to the invention and should not be interpreted as limiting it in any way.

$[IrCl_6]^{2-}$
$[IrCl_6]^{3-}$
$[IrBr_6]^{2-}$
$[IrBr_6]^{3-}$
$[IrI_6]^{2-}$

As another preferable state of iridium used in the invention, the hexa-coordinated complex of Ir as a center metal having ligands comprising at least one ligand exclusive of halogen or cyan is preferable whereupon the hexa-coordinated complex of Ir as a center metal having a ligand which is a member selected from the group consisting of $H_2O$, OH, O, OCN, a thiazole, a substituted thiazole, a thiadiazole, a substituted thiadiazole, a thiatriazole and a substituted thiatriazole is preferable and, further, the hexa-coordinated complex of Ir as a center metal having ligands comprising at least one ligand which is a member selected from the group consisting of $H_2O$, OH, O, OCN, a thiazole, a substituted thiazole, a thiadiazole, a substituted thiadiazole, a thiatriazole and a substituted thiatriazole and remaining ligands which are Cl, Br or I is more preferable and, still further, the hexa-coordinated complex of Ir as a center metal having ligands comprising one or two ligands which are 5-methylthiazole and remaining ligands which are Cl, Br or I is most preferable.

Specific examples of such hexa-coordinated complexes of Ir as a center metal having ligands comprising at least one ligand which is a member selected from the group consisting of $H_2O$, OH, O, OCN, a thiazole, a substituted thiazole, and remaining ligands which are Cl, Br or I are given below to illustrate iridium according to the invention and should not be interpreted as limiting it in any way.

$[Ir(H_2O)Cl_5]^{2-}$
$[Ir(H_2O)_2C_4]^{-}$
$[Ir(H_2O)_2Br_5]^{2-}$
$[Ir(H_2O)_2Br_4]^{-}$
$[Ir(OH)Cl_5]^{3-}$ $[Ir(OH)_2Cl_4]^{3-}$
$[Ir(OH)Br_5]^{3-}$
$[Ir(OH)_2Br_4]^{3-}$
$[Ir(O)Cl_5]^{4-}$
$[Ir(O)_2Cl_4]^{5-}$
$[Ir(O)Br_5]^{4-}$
$[Ir(O)_2Br^4]^{5-}$
$[Ir(OCN)Cl]^{3-}$
$[Ir(OCN)Br_5]^{3-}$
$[Ir(thiazole)Cl_5]^{2-}$
$[Ir(thiazole)_2Cl_4]^{-}$
$[Ir(thiazole)Br]^{2-}$
$[Ir(thiazole)_2Br_4]^{-}$
$[Ir(5\text{-methylthiazole})Cl_5]^{2-}$
$[Ir(5\text{-methylthiazole})_2Cl_4]^{-}$
$[Ir(5\text{-methylthiazole})Br_5]^{2-}$
$[Ir(5\text{-methylthiazole})_2Br_4]^{-}$ Above-described problems of the invention are favorably solved by using alone any one of the hexa-coordinated complex of Ir as a center metal having 6 ligands which are all Cl, Br or I and the hexa-coordinated complex of Ir as a center metal having ligands comprising at least one ligand exclusive of halogen or cyan. However, in order to further enhance an effect of the invention, it is preferable to simultaneously use the hexa-coordinated complex of Ir as a center metal having 6 ligands which are all Cl, Br or I and the hexa-coordinated complex of Ir as a center metal having ligands comprising at least one ligand exclusive of halogen or cyan. Further, in regard to the hexa-coordinated complex of Ir as a center metal having ligands comprising at least one ligand which is a member selected from the group consisting of $H_2O$, OH, O, OCN, a thiazole and a substituted thiazole and remaining ligands which are Cl, Br or I, it is preferable to use a complex constituted by, out of these ligands, two types of ligands (one type of ligand selected from the group consisting of $H_2O$, OH, O, OCN, a thiazole and a substituted thiazole and other ligand selected from the group consisting of Cl, Br and I).

Above-described metal complexes are anionic ions and, when each of these metal complexes forms a salt with a cationic ion, such counter cationic ion is preferably easily soluble in water. Specific examples of preferable cationic ions include alkali metal ions such as a sodium ion, a potassium ion, a rubidium ion, a cesium ion and lithium ion; an ammonium ion; and an alkyl ammonium ion. These metal complexes can be dissolved in a mixed solvent of water and an appropriate water-miscible organic solvent (for example, alcohols, ethers, glycols, ketones, esters and amides). These iridium complexes are added while grains are being formed preferably in an amount of from $1\times10^{-10}$ mol to $1\times10^{-3}$ mol and most preferably in an amount of from $1\times10^{-8}$ mol to $1\times10^{-5}$ mol per mol of Ag.

It is preferable that any of the iridium complexes according to the invention is directly added in a reaction solution at the time of forming silver halide grains or once added in an aqueous halide solution for forming the silver halide grains or in another solution therefrom and, then, the resultant solution is added to a grain-forming reaction solution, thereby allowing the iridium complex to be incorporated in grains. Further, it is also preferable that a fine grain in which the iridium complex is previously incorporated is physically ripened, thereby allowing the iridium complex to be incorporated in the silver halide grains. Still further, a combination of such methods as described above can also incorporate the iridium complex in the silver halide grains.

When these complexes are incorporated in the silver halide grains, these complexes are allowed to be uniformly present inside the silver halide grains; however, as disclosed in JP-A Nos. 4-208936, 2-125245 and 3-188437, it is also preferable that the complexes are each allowed to be present in a surface layer of the grain and it is still preferable that the complex is allowed to be present only in the inside of the grain and, then, a layer which does not contain the complex is added to the surface of the grain. Further, as disclosed in U.S. Pat. Nos. 5,252,451 and 5,256,530, it is preferable that a fine grain in which the complex is incorporated is physically ripened to modify a grain surface phase. Still further, a combination of such methods as described above can be used whereupon plural types of complexes may be incorporated in one silver halide grain. A halogen composition of a site in which the complex is incorporated is not particularly limited, but it is preferable that the hexa-coordinated complex of Ir as a center metal having 6 ligands which are all Cl, Br or I is contained in a portion having a silver bronde concentration.

According to the invention, other metal ions than iridium can be doped in at least one of the inside of the silver halide grains or the surface thereof. As for such metal ions, transition metal ions are preferably used. Among other things, a transition metal ion of iron, ruthenium, osmium, lead, cadmium or zinc is preferable. Further, it is more preferable that these metal ions are used along with a ligand in a form of hexa-coordinated octahedral complex. When an inorganic compound is used as the ligand, it is preferable to use one member selected from the group consisting of a cyanide ion, a halide ion, a thiocyano, a hydroxide ion, a peroxide ion, an azide ion, a nitrite ion, water, ammonia, a nitrosyl ion and thionitrosyl ion. It is also preferable to use them after being coordinated to the above-described metal ion of iron, ruthenium, osmium, lead, cadmium or zinc and it is still preferable to use a plural types of ligands in one complex molecule. Furthermore, an organic compound can be used as a ligand whereupon, as for preferable organic compounds, mentioned is at least one of a chain compound having a main chain of 5 or less carbon atoms and a 5- or 6-membered heterocyclic compound. As for more preferable organic compounds, mentioned is a compound which contains a nitrogen atom, a phosphorous atom, an oxygen atom or a sulfur atom in a molecule as a coordinate atom to a metal and, as for particularly preferable ones, mentioned are a furan, thiophene, oxazole, isooxazole, thiazole, isothiazole, imidazole, pyrazole, triazole, furazan, pyran, pyridine, pyridazine, pyrimidine and pyrazine and, further, a compound derived from introducing a substitute into each of these compounds which is allowed to be a platform is also preferable.

As for preferable combinations of metal ions and ligands, mentioned is a combination of an iron ion and a ruthenium ion and a cyanide ion. According to the invention, it is preferable that iridium and these compounds are simultaneously used. It is also preferable that, among these compounds, the cyanide ion accounts for a majority of ligands to iron or ruthenium as a center metal and at least one member selected from the group consisting of a thiocyano, ammonium, water, a nitrosyl ion, dimethyl sulfoxide, pyridine, pyrazine and 4,4'-bipyridine accounts for the remaining ligands thereto. Most preferably, the cyanide ion accounts for all of 6 ligands to a center metal, thereby forming a hexacyanoiron complex or a hexacyanoruthenium complex. These complexes containing cyanide ions as ligands are each added preferably in an amount of from $1\times10^{-8}$ mol to $1\times10^{-2}$ mol and most preferably in an amount of from $1\times10^{-6}$ mol to $5\times10^{-4}$ mol per mol of Ag while forming grains. When ruthenium or osmium are a center metal, it is preferable that at least one member selected from the group consisting of a nitrosyl ion, a thionitrosyl ion and a water molecule, and a chloride ion are simultaneously used as ligands. More preferably, a pentachloronitrosyl complex, a pentachlorothionitrosyl complex or a pentachloroaqua complex is formed and, also preferably, a hexachloro complex is formed. These complexes are each added preferably in an amount of $1\times10^{-10}$ mol to $1\times10^{-6}$ mol and more preferably from $1\times10^{-9}$ mol to $1\times10^{-6}$ mol per mol of Ag while forming grains.

The silver halide emulsion of the invention is ordinarily subjected to chemical sensitization. As for the chemical sensitization methods, sulfur sensitization represented by addition of a labile sulfur compound, a noble metal sensitization represented by gold sensitization, reduction sensitization and the like are used either each individually or simultaneously. As for compounds for use in chemical sensitization, such compounds as described in from a bottom-right column, page 18 to a top-right column, page 22 of JP-A No. 62-215272 are preferably used. Among these compounds, particularly, compounds which have been subjected to gold sensitization are preferable. This is because that, by performing gold sensitization, fluctuations of photographic properties at the time of scanning exposure by a laser or the like can be further small.

In order to perform gold sensitization on the silver halide emulsion of the invention, various types of inorganic gold compounds or gold (I) complexes having an inorganic ligand and gold (I) compounds having an organic ligand can be utilized. As the such inorganic gold compounds, for example, chloroauric acid or a salt thereof can be used while, as for the gold (I) complexes containing an inorganic ligand, for example, gold dithiocyanate compounds such as potassium aurous dithiocyanate or compounds such as trisodium aurous dithiosulfte can be used.

It is preferable that the silver halide emulsion of the invention has been subjected to gold sensitization by colloidal gold sulfide or a gold sensitizer having a gold complex stability constant log $\beta_2$ of from 21 to 35. Manufacturing methods of such colloidal gold sulfide are described in Research Disclosure, Item No. 37154, Solid State Ionics, Vol. 79, pp. 60–66, 1995, Compt. Rend. Hebt. Seances Acad. Sci. Sect. B, Vol. 263, p. 1328, 1966 and the like. Various sizes of the colloidal gold sulfide can be utilized whereupon that having a grain size of 50 nm or less can even be used. An amount thereof to be used may vary widely depending on cases, but is ordinarily, in terms of gold, from $5\times10^{-7}$ mol to $5\times10^{-3}$ mol and preferably from $5\times10^{-6}$ mol to $5\times10^{-4}$ mol per mol of Ag. According to the invention, the gold sensitization may be combined with at least one of other sensitization methods such as sulfur sensitization, selenium sensitization, tellurium, reduction sensitization and noble metal sensitization by using other compounds than the gold compound.

Next, gold sensitizers each having a gold complex stability constant log $\beta_2$ of from 21 to 35 will be explained.

Measurement of the gold complex stability constant log $\beta_2$ is performed by adopting measuring methods described in Comprehensive Coordination Chemistry, Chapt. 55, p. 864, 1987, Encyclopedia of Electrochemistry of the Elements, Chapt. IV-3, 1975, Journal of the Royal Netherlands Chemical Society, Vol. 101, p. 164, 1982 and references cited in the above-described documents, and the like under conditions that a measuring temperature is 25° C., a pH is adjusted to be 6.0 by a buffer solution of potassium dihydrogen phosphate/disodium hydrogen phosphate and an ion intensity is 0.1 M (KBr) to obtain a log $\beta_2$ value from a gold potential value by calculation. The log $\beta_2$ value of a thiocyanic acid ion obtained by the above-described measuring method is 20.5 which is approximate to 20 of the value described in Comprehensive Coordination Chemistry, Chapt. 55, p. 864, Table 2, 1987.

Gold sensitizers each having a gold complex stability constant log $\beta_2$ of from 21 to 35 are represented by the following general formula (I):

$$\{(L^1)_x(\mathrm{Au})_y(L^2)_z\cdot Q_q\}P \qquad \text{(I)}$$

wherein $L^1$ and $L^2$ each individually represent a compound in which a log $\beta_2$ value is between 21 and 35, preferably between 22 and 31 and more preferably between 24 and 28 and also each individually represent, for example, at least one member selected from the group consisting of a compound containing at least one labile sulfur group which can generate silver sulfide by reacting with a silver halide, a hydantoin compound, a thioether compound, a mesoionic compound, —SR', a heterocyclic compound, a phosphine compound, an amino acid derivative, a sugar derivative and a thiocyano group and may be same with or different from each other, wherein R' prepresents at least one group selected from the group consisting of an aliphatic hydrocarbon group, an aryl group, a heterocyclic group, an acyl group, a carbamoyl group, a thiocarbamoyl group and sulfonyl group;

Q represents a counter anion or a counter cation necessary for neutralizing a charge of a compound;

x and z each individually represent an integer of from 0 to 4, but never simultaneously represent 0;

y and p each individually represent 1 or 2; and q represents a value of from 0 to 1 inclusive of decimals.

The compound represented by the general formula (I) is preferably a compound in which $L^1$ and $L^2$ each individually represent at least one member selected from the group consisting of a compound containing at least one labile sulfur group which can generate silver sulfide by reacting with a silver halide, a hydantoin compound, a thioether compound, a mesoionic compound, —SR', a heterocyclic compound and a phosphine compound and also x, y and z each individually represent 1.

The compound represented by the general formula (I) is more preferably a compound in which $L^1$ and $L^2$ each individually represent at least one member selected from the group consisting of a compound containing at least one labile sulfur group which can generate silver sulfide by reacting with a silver halide, a mesoionic compound and —SR' and also x, y, z and p each individually represent 1.

Gold compounds represented by the general formula (I) will be described in detail below.

As for the compounds, being represented by each of $L^1$ and $L^2$ in the general formula (I), which each contain at least one labile sulfur group that can generate silver sulfide by reacting with a silver halide, mentioned are thioketones (for example, thioures, thioamides or rhodanines), thiophosphates and thiosulfates.

The compounds each containing at least one labile sulfur group which can generate silver sulfide by reacting with a silver halide are preferably thioketones (more preferably, thioureas and thioamides) and thiosulfates.

As for the hydantoin compounds represented by each of $L^1$ and $L^2$ in the general formula (I), mentioned are an unsubstituted hydantoin and N-methyl hydantoin while, as for the thioether compounds, mentioned are chain or cyclic thioethers (for example, bishydroxyethylthioether, 3,6-dithia-1,8-octane diol and 1,4,8,11-tetrathiacyclotetradecane) which each have from 1 to 8 thio groups and which are connected thereto via a substituted or unsubstituted linear or branched alkylene group (for example, ethylene or triethylene) or a phenylene group; and examples of such mesoionic compounds include mesoionic-3-mercapto-1, 2 and 4-triazoles (for example, mesoionic-1, 4,5-trimethy-3-mercapto-1,2,4-triazole).

In a case in which $L^1$ and $L^2$ each individually represent —SR' in the general formula (I), when R' represents an aliphatic hydrocarbon group, examples of such aliphatic hydrocarbon groups include a substituted or an unsubstituted linear or branched alkyl group having from 1 to 30 carbon atoms (for example, a methyl group, an ethyl group, a isopropyl group, an n-propyl group, an n-butyl group, a t-butyl group, a 2-pentyl group, an n-hexyl group, an n-octyl group, a t-octyl group, a 2-ethylhexyl group, 1,5-dimethylhexyl group, an n-decyl group, an n-dodecyl group, an n-tetradecyl group, an n-hexadecyl group, a hydroxyethyl group, a hydroxypropyl group, a 2,3-dihydroxypropyl group, a carboxymethyl group, a carboxyethyl group, a sodium sulfoethyl group, a diethylaminoethyl group, a diethylaminopropyl group, a butoxypropyl group, an ethoxyethoxyethyl group or an n-hexyloxypropyl group) a substituted or an unsubstituted cyclic alkyl group having from 3 to 18 carbon atoms (for example, a cyclopropyl group, a cyclopentyl group, a cyclohexyl group, a cyclooctyl group, an adamantly group or a cyclododecyl group), an alkenyl group having from 2 to 16 carbon atoms (for example, an allyl group, a 2-butenyl group or a 3-pentenyl group), an alkynyl group having from 2 to 10 carbon atoms (for example, a propargyl group or a 3-pentynyl group) and an aralkyl group having from 6 to 16 carbon atoms (for example, a benzyl group); when R' represent an aryl group, examples of such aryl groups include a substituted or an unsubstituted phenyl or naphthyl group having from 6 to 20 carbon atoms (for example, an unsubstitued phenyl group, an unsubstituted naphthyl group, a 3,5-dimethylphenyl group, a 4-butoxyphenyl group, a 4-dimethylaminophenyl group or a 2-carboxyphenyl group); when R' represent a heterocyclic group, examples of such heterocyclic groups include a substituted or an unsubstitued nitrogen-containing hetero 5-membered cycle (for example, an imidazolyl group, a 1,2,4-triazolyl group, a tetrazolyl group, an oxadiazolyl group, a thiadiazolyl group, a benzimidazolyl group or a purinyl group), a substituted or an unsubstitued nitrogen-containing hetero 6-membered cycle (for example, a pyridyl group, a piperidyl group, a 1,3,5-triazino group or a 4,6-dimercapto-1,3,5-triazino group), a furyl group and a thienyl group; when R' represents an acyl group, examples of such acyl groups include an acetyl group and a benzoyl group; when R' represents a carbamoyl group, examples of such carbamoyl groups include dimethylcarbamoyl group; when R' represents a thiocarbamoyl group, examples of such thiocarbamoyl groups include diethylthiocarbamoyl group; and when R' represents a sulfonyl group, examples of such sulfonyl groups include a substituted or an unsubstituted alkylsulfonyl group having from 1 to 10 carbon atoms (for example, a methane sulfonyl group or an ethane sulfonyl group) and a substituted or an unsubstituted phenylsulfonyl group having from 6 to 16 carbon atoms (for example, a phenylsulfonyl group).

Further, as for —SR' represented by each of $L^1$ and $L^2$, R' is preferably an aryl group or a heterocyclic group, more preferably a heterocyclic group, still more preferably a 5- or 6-membered nitrogen-containing heterocyclic group and most preferably a nitrogen-containing heterocyclic group substituted with a water-soluble group (for example, a sulfo group, a carboxyl group, a hydroxyl group or an amino group).

As for the such heterocyclic compounds represented by each of $L^1$ and $L^2$ in the general formula (I), mentioned are substituted or unsubstituted nitrogen-containing 5-membered heterocycles (for example, pyrroles, imidazoles, pyrazoles, 1,2,3-triazoles, 1,2,4-triazoles, tetrazoles, oxazoles, isooxazoles, isothiazoles, oxadiazoles, thiadiazoles, pyrrolidines, pyrrolines, imidazolidines, imidazolines, pyrazolidines, pyrazolines or hydantoins), heterocycles having the above-described 5-membered cycles (for example, indoles, isoindoles, indolizines, indazoles, benzimidazoles, purines, benzotriazoles, carbazoles, tetraazaindenes, benzothiazoles or indolines), substituted or unsubstituted 6-membered nitrogen-containing heterocycles (for example, pyridines, pyrazines, pyrimidines, pyridazines, triazines, thiadiazines, piperidines, piperazines or morpholines), heterocycles having the above-described 6-membered cycles (for example, quinolines, isoquinolines, phthalazines, naphthyridines, quinoxalines, quinazolines, pteridines, phenanthridines, acridines, phenanthrolines or phenazines), substituted or unsubstituted furans, substituted or unsubstituted thiophenes, benzothiazolium and the like.

Such heterocyclic compounds represented by each of $L^1$ and $L^2$ are preferably saturated nitrogen-containing 5- or 6-membered heterocycles or heterocycles containing the above-described saturated nitrogen-containing 5- or 6-membered heterocycles whereupon examples of such heterocyclic compounds include pyrroles, imidazoles, pyrazoles, 1,2,4-triazoles, oxadiazoles, thiadiazoles, imidazolines, indoles, indolizines, indazoles, benzimidazoles, purines, benzotriazoles, carbazoles, tetraazaindenes, benzothiazoles, pyridines, pyrazines, pyrimidines, pyridazines, triazines, quinolines, isoquinolines and phthalazines and, further, preferably heterocyclic compounds which are known in the art as antifoggants (for example, indazoles, benzimidazoles, benzotriazoles and tetraazaindenes).

As for such phosphine compounds represented by each of $L^1$ and $L^2$, mentioned are phosphines substituted with at least one group selected from the group consisting of an aliphatic hydrocarbon group having from 1 to 30 carbon atoms, an aryl group having from 6 to 20 carbon atoms, a heterocyclic group (for example, a pyridyl group), a substituted or an unsubstituted amino group (for example, a dimethylamino group) and an alkyloxy goup (for example, a methyloxy group or an ethyloxy group) whereupon the phosphine compounds are preferably phosphines substituted with an alkyl group having from 1 to 10 carbon atoms or an aryl group having from 6 to 12 carbon atoms (for example, triphenylphosphine and triethylphosphine).

Further, it is preferable that the mesoionic compound, —SR' and the heterocyclic compound are each substituted with a labile sulfur group (for example, a thioureido group) which can generate silver sulfide by reacting with silver halide.

Still further, the compounds represented by each of $L^1$ and $L^2$ may have substituents as many as possible. Examples of the substituents include a halogen atom (for example, a fluorine atom, a chlorine atom or a bromine atom), an aliphatic hydrocarbon group (for example, a methyl group, an ethyl group, an isopropyl group, an n-propyl group, a t-butyl group, an n-octyl group, a cyclopentyl group or a cyclohexyl group), an alkenyl group (for example, an allyl group, a 2-butenyl group or a 3-pentenyl group), an alkynyl goup (for example, a propargyl group or a 3-pentynyl group), an aralkyl group (for example, a benzyl group or a phenethyl group), an aryl group (for example, a phenyl group, a naphthyl group or a 4-methylphenyl group), a heterocyclic group (for example, a pyridyl group, a furyl group, an imidazolyl group, a piperidinyl group or morpholine), an alkyloxy group (for example, a methoxy group, an ethoxy group, a butoxy group, a 2-ethylhexyloxy group, an ethoxyethoxy group, a methoxyethoxy group), an aryloxy group (for example, a phenoxy group or a 2-naphthyloxy group), an amino group (for example, an unsubstituted amino group, a dimethylamino group, a diethylamino group, a dipropylamino group, a dibutylamino group, an ethylamino group, a dibenzylamino group or ananilino group), an acylamino group (for example, acetylamino group or a benzoylamino group), an ureido group (for example, an unsubstituted ureido group, an N-methylureido group or an N-phenylureido group), a thioureido group (for example, an unsubstituted thioureido group, an N-methylthioureido group or an N-phenylthioureido group), a selenoureido group (for example, an unsubstituted selenoureido), a phosphine selenido group (for example, diphenylphosphine selenido), a telluroureido group (for example, an unsubstituted telluroureido group), a urethane group (for example, a methoxycarbonylamino group or a phenoxycarbonylamino group) a sulfonamide group (for example, a methylsulfonamide group or a phenylsulfonamide group), a sulfamoyl group (for example, an unsubstituted sulfamoyl group, an N,N-dimethylsulfamoyl group or an N-phenylsulfamoyl grop), a carbamoyl group (for example, an unsubstituted carbamoyl group, an N,N-diethylcarbamoyl group or an N-phenylcarbamoyl), a sulfonyl group (for example, a methane sulfonyl group or a p-toluene sulfonyl group), a sulfinyl group (for example, a methylsulfinyl group or a phenylsulfinyl group), an alkyloxycarbonyl group (for example, a methoxycarbonyl group or an ethoxycarbonyl group), an aryloxycarbonyl group (for example, a phenoxycarbonyl group), an acyl group (for example, an acetyl group, a benzoyl group, a formyl group or a pivaloyl group), an acyloxy group (for example, an acetoxy group or a benzoyloxy group), a phosphoric acid amide group (for example, an N,N-diethylphosphoric acid amide), an alkylthio group (for example, a methylthio group or an ethylthio group), an arylthio group (for example, a phenylthio), a cyano group, a sufo group, a thiosulfonic acid group, a sulfinic acid group, a carboxyl group, a hydroxy group, a mercapto group, a phosphono group, a nitro group, a sulfino group, a ammonio group (for example, trimethylammonio group), a phosphonio group, a hydrazine group, a thiazolino group, a silyloxy group (for example, a t-butyldimethylsilyloxy group or a t-butyldiphenylsilyloxy group) and the like. Further, when two or more substituents are present in the compound, they are same with or differenct from each other.

Next, Q and q in the general formula (I) will be explained.

As for such counter anions represented by Q in the general formula (I), mentioned are a halogenium ion (for example, $F^-$, $Cl^-$, $Br^-$ or $I^-$), a tetrafluoroborate ion ($BF_4^-$), a hexafluorophosphate ion ($PF_6^-$), a sulfuric acid ion ($SO_4^{2-}$), an arylsulfonate ion (for example, a p-toluene sulfonate ion or a naphthalene-2,5-disulfonate ion), a carboxy ion (for example, an acetic acid ion, a trifluoroacetic acid ion, an oxalic acid ion or a benzoic acid ion) and the like, while, as for such counter cations represented by Q, mentioned are an alkali metal ion (for example, a lithium ion, a sodium ion, a potassium ion, a rubidium ion or a cesium ion), an alkali earth metal ion (for example, a magnesium ion or a calcium ion), a substituted or an unsubstituted ammonium ion (for example, an unsubstituted ammonium ion, triethyl ammonium or tetramethyl ammonium), a substituted or an unsubstituted pyridinium ion (for example, an unsubstituted pyridinium ion or a 4-phenylpyridinium ion) and the like and, further, a proton. Further, q, being a number of Q for neutralizing a charge of the compound, represents a value of from 0 to 1 and may be a decimal.

Preferable examples of such counter anions represented by Q include a halogenium ion (for example, $Cl^-$, $Br^-$), a tetrafluoroborate ion, a hexafluorophosphate ion and a sulfate ion, whereas preferable examples of such counter cations represented by Q include an alkali metal ion (for example, a sodium ion, a potassium ion, a rubidium ion or a cesium ion) a substituted or an unsubstituted ammonium ion (for example, an unsubstituted ammonium ion, triethyl ammonium or tetramethyl ammonium) and a proton.

Specific examples (L-1 to L-17) are given to illustrate the compounds represented by $L^1$ or $L^2$ below and should not be interpreted as limiting the invention in any way. Numbers in parentheses indicate respective log $\beta_2$ values of the compounds.

(L-1)

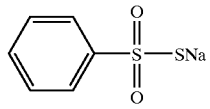

(22)

(L-2)

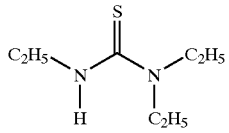

(24)

(L-3)

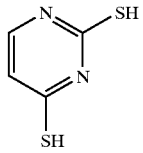

(25)

(L-4)

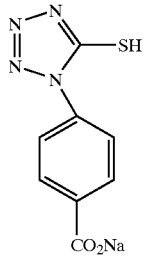

(25)

(L-5)

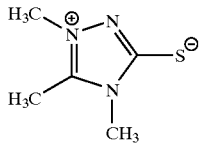

(26)

(L-6)

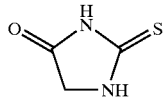

(27)

-continued (L-7)

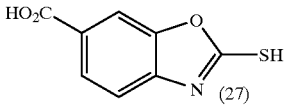

(27)

(L-8)

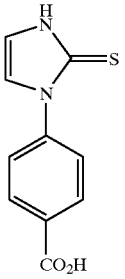

(27)

(L-9)

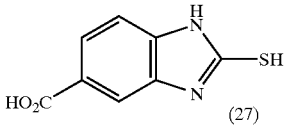

(27)

(L-10)

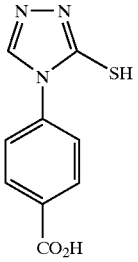

(27)

(L-11)

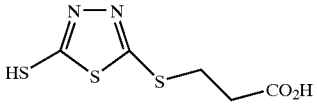

(27)

(L-12)

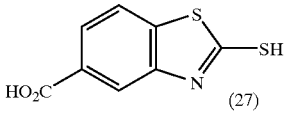

(27)

(L-13)

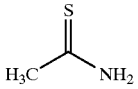

(28)

(L-14)

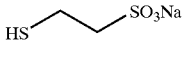

(28)

(L-15)

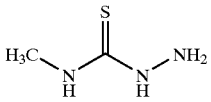

(29)

(L-16)

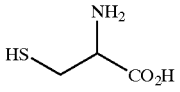

(29)

-continued (L-17)

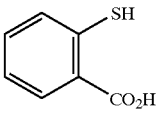

(30)

The compounds represented by the general formula (I) can be synthesized by known methods with reference to, for example, Inorg. Nucl. Chem. Letters, Vol. 10, p. 641, 1974, Transition Met. Chem. Vol. 1, p. 248, 1976, Acta. Cryst. B32, p. 3321, 1976, JP-A No. 8-69075, JP-B No. 45-8831, EP-A NO. 915371, JP-A Nos. 6-11788, 6-501789, 4-267249 and 9-118685.

Specific examples (S-1 to S-19) are given below to illustrate the compounds represented by the general formula (I) according to the invention and should not be interpreted as limiting it in any way.

(S-1)

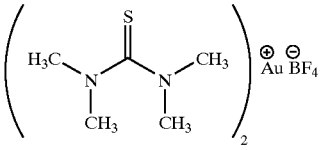

(S-2)

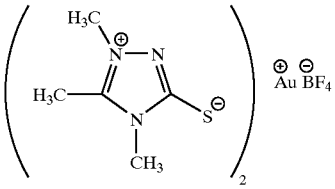

(S-3)

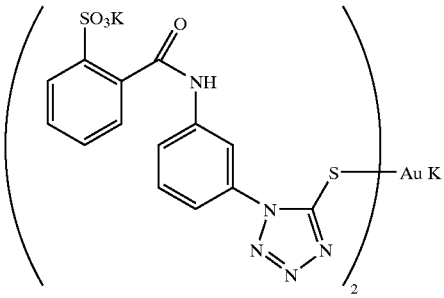

(S-4)

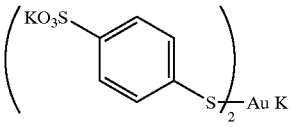

(S-5)

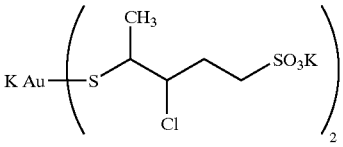

-continued (S-6)

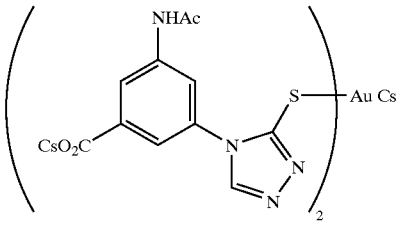

(S-7)

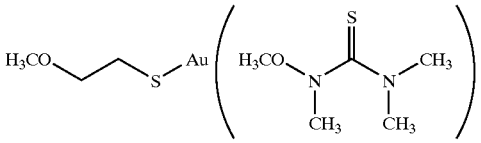

(S-8)

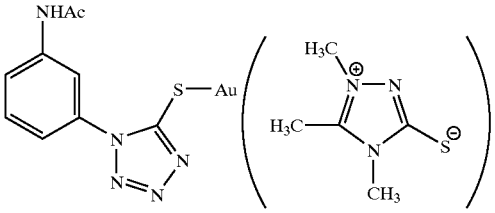

(S-9)

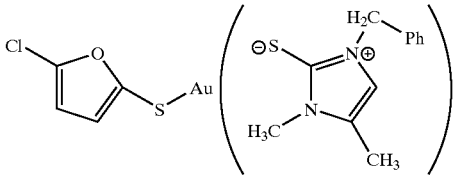

(S-10)

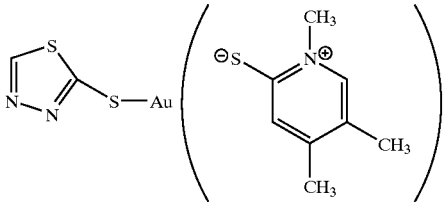

(S-11)

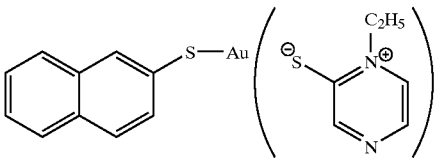

(S-12)

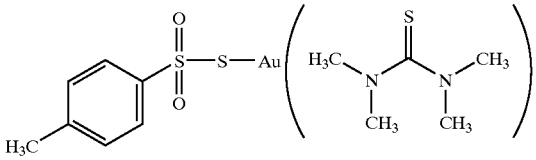

(S-13)

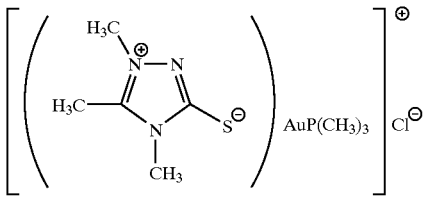

-continued (S-14)

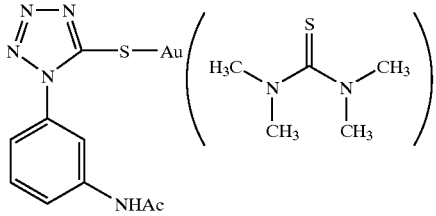

(S-15)

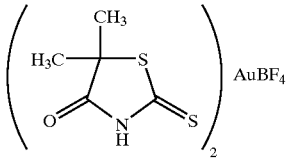

(S-16)

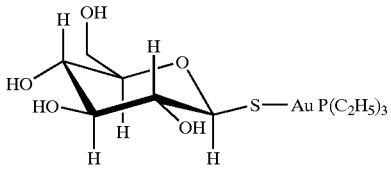

(S-17)

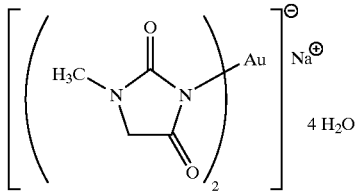

(S-18)

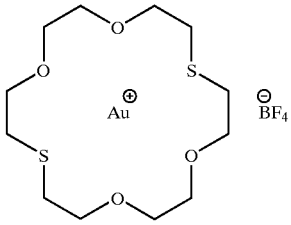

(S-19)

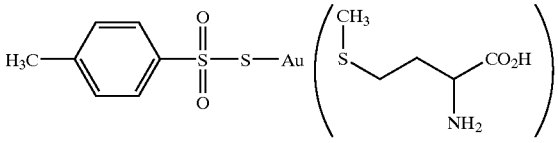

Gold sensitization according to the invention is ordinarily performed by adding a gold sensitizer to an emulsion and, then, stirring the resultant emulsion for a predetermined period of time at an elevated temperature (preferably 40° or more). An amount of the gold sensitizer to be added is varies in accordance with various types of conditions, but is preferably, as an approximate figure, from $1\times10^{-7}$ mol to $1\times10^{-4}$ per mol of silver halide.

As for the gold sensitizers, other gold compounds which are ordinarily used than the above-described compounds can simultaneously be used. Examples of such gold compounds capable of being simultaneously used include a salt of chloroauric acid, potassium chloroaurate, auricrichloride, potassium auric thiocyanate, potassium iodoaurate, tetracyanoauric acid, ammonium aurothiocyanate and pyridyltrichloro gold.

The emulsion of the invention can simultaneously use chemical sensitization together with the gold sensitization.

As for such chemical sensitization methods, sulfur sensitization, selenium, tellurium, sensitization using other noble metals than gold or reduction sensitization can be used. As for compounds for use in chemical sensitization, such compounds as described in from a bottom-right column, page 18 to a top-right column, page 22 of JP-A No. 62-215272 are preferably used.

For the purpose of preventing fog from being generated during a production process, storage or photographic processing of the photosensitive material or stabilizing photographic performance, the silver halide emulsion of the invention can be added with various types of compounds or precursors thereof. As for such compounds or precursors thereof, such compounds as described in pages 39 to 72 of JP-A No. 62-215272 are, as specific examples, preferably used. Further, a 5-arylamino-1,2,3,4-thiatriazole compound (an aryl residue thereof has at least one electron absorptive group) can also be preferably used.

In order to enhance storage ability of the silver halide emulsion of the invention, hydroxamic acid derivatives described in JP-A No. 11-109576, cyclic ketones described in JP-A No. 11-327094 which has a double bond adjacent to a carbonyl group and also both ends thereof substituted with an amino group or a hydroxyl group (particularly those represented by the general formula (I); paragraphs [0036] to [0071] thereof are herein incorporated by reference), catechols or hydroquinones substituted with a sulfo group which are described in JP-A No. 11-143011 (for example, 4,5-dihydroxy-1,3-benzene disulfonic acid, 2,5-dihydroxy-1,4-benzene sulfonic acid, 3,4-dihydroxybenzene sulfonic acid, 2,3-dihydroxybenzene sulfonic acid, 2,5-dihydroxybenzene sulfonic acid, 3,4,5-trihydroxybenzene sulfonic acid and salts thereof), hydroxyamines represented by the general formula (A) in U.S. Pat. No. 5,556,741 (descriptions in column 4, line 56 to column 11, line 22 thereof can favorably be applied to the present invention and, accordingly, are herein incorporated by reference.) and water-soluble reducing agents represented by the general formulas (I) to (III) of JP-A No. 11-102045 are also favorably used in the present invention.

Still further, the silver halide emulsion of the invention may contain a spectral sensitizing dye for the purpose of exhibiting sensitivity to a desired light wavelength region, that is, being imparted with spectral sensitivity. As for spectral sensitizing dyes for use in the spectral sensitivity of blue, green and red regions, mentioned are those described in F. M. Harmer, Heterocyclic Compounds-Cyanine Dyes and Related Compounds, John Wiley & Sons, New York & London, 1964. As for specific examples of such compounds and spectral sensitization methods, those described in top-right column, page 22 to page 38 of the previously cited document, namely, JP-A 62-215272 can favorably be used. As for the spectral sensitizing dyes sensitive to red light for use in silver halide emulsion grains having a particularly high silver chloride content, those described in JP-A No. 3-123340 are extremely preferable from the standpoint of stability, adsorption intensity, temperature dependability of exposure and the like.

An amount of such spectral sensitizing dye to be added widely varies depending on cases, but is preferably in the range of from $0.5\times10^{-6}$ mol to $1.0\times10^{-2}$ mol and more preferably from $1.0\times10^{-6}$ mol to $5.0\times10^{3}$ mol per mol of silver halide.

Silver Halide Photographic Photosensitive Material

Next, a silver halide photographic photosensitive material will be explained.

The silver halide photographic photosensitive material of the invention may be for either black-and-white or color, but the silver halide emulsion of the invention is preferably used in a silver halide color photographic photosensitive material.

The silver halide color photographic photosensitive material in which the silver halide emulsion of the invention is preferably used (hereinafter, referred to also as "photosensitive material" in short), comprising at least one of a yellow dye forming coupler-containing silver halide emulsion layer, a magenta dye forming coupler-containing silver halide emulsion layer and a cyan dye forming coupler-containing silver halide emulsion layer on a support, is characterized in that at least one of the above-described silver halide emulsion layers contains the silver halide emulsion of the invention. According to the invention, the yellow dye forming coupler-containing silver halide emulsion layer, the magenta dye forming coupler-containing silver halide emulsion layer and the cyan dye forming coupler-containing silver halide emulsion layer function as a yellow color-forming layer, a magenta color-forming layer and a cyan color-forming layer, respectively. Respective silver halide emulsions contained in the yellow color-forming layer, the magenta color-forming layer and the cyan color-forming layer preferably have sensitivity to light in wavelength regions different from one another(for example, light in blue region, light in green region and light in red region).

The photosensitive material of the invention may optionally further comprises other layers to be described below than the yellow color-forming layer, the magenta color-forming layer and the cyan color-forming layer; examples of such other layers include a hydrophilic colloidal layer, an anti-halation layer, an intermediate layer and a colored layer.

In the photosensitive material of the invention, a known photographic element and an additive may be used.

For example, as for a photographic support, a transmission type support or a reflection type support can be used. As for such transmission type supports, a support in which an information recording layer such as a magnetic layer is provided on a transparent film such as a cellulose nitrate film or polyethylene terephthalate, or, in another case, polyester such as that of 2,6-naphthalene dicarboxylic acid (NDCA) and ethylene glycol (EG) or of NDCA, terephthalic acid and EG is preferably used. As for such reflection type supports, a reflection type support that is laminated particularly with a plurality of polyethylene layers or polyester layers whereupon at least one of such water resistant resin layers (laminate layers) contains a white pigment such as titanium oxide is preferably used.

As for a preferable reflection type support according to the invention, mentioned is a reflection type support which has a microvoided polyolefin layer on the side of a paper substrate on which the silver halide layer is provided. Such polyolefin layer may comprise a multiple of layers; in this occasion, a layer adjacent to a gelatin layer on the side of the silver halide emulsion layer is preferably a non-microvoided polyolefin layer(for example, polypropylene or polyethylene) and the microvoided polyolefin layer is preferably provided to the side near to a surface of the paper substrate. Density of a multiple of or one polyolefin layer which is positioned between the paper substrate and a photographic constituting layer is preferably from 0.40 g/ml to 1.0 g/ml and more preferably from 0.50 g/ml to 0.70 g/ml. Further, thickness of a multiple of or one polyolefin layer which is positioned between the paper substrate and a photographic constituting layer is preferably from 10 $\mu$m to 100 $\mu$m and more preferably from 15 $\mu$m to 70 $\mu$m. Still further, a ratio of thickness of the paper substrate to the photographic constituting layer is preferably from 0.05 to 0.2 and more preferably from 0.1 to 0.15.

Furthermore, it is also preferable from the standpoint of enhancing rigidity of the reflection type support that the polyolefin layer is provided on the reverse (back) side of the paper substrate opposite to the side on which the photographic constituting layer is located; on this occasion, the polyolefin layer provided on the reverse side is preferably polyethylene or polypropylene having a surface of matt finish and more preferably polypropylene having a surface of matt finish. Thickness of the polyolefin layer provided on the reverse side is preferably from 5 to 50 and more preferably from 10 $\mu$m to 30 $\mu$m and, further, density thereof is preferably from 0.7 g/ml to 1.1 g/ml. As for preferable embodiments relating to the polyolefin layer to be provided on the paper substrate in the reflection type support according to the invention, mentioned are examples which are described in JP-A Nos. 10-333277, 10-333278, 11-52513 and 11-65024; and EPA Nos. 0880065 and 0880066.

Further, a fluorescent whitening agent is preferably contained in the water resistant resin layer. Still further, the hydrophilic colloidal layer in which the fluorescent whitening agent is dispersed may separately be prepared. As for such fluorescent whitening agents, those of a benzoxazole type, a coumarin type and a pyrazoline type can preferably be used and, still further, those of a benzoxazolyl naphthalene type and a benzoxazolyl stilbene are more preferably used. An amount of the fluorescent whitening agent to be used is not particularly limited, but is preferably from 1 mg/m$^2$ to 100 mg/m$^2$. When the fluorescent whitening agent is mixed to the water resistant resin, a mixing ratio of the fluorescent whitening agent is, based on the entire resin mass, preferably from 0.0005% by weight to 3% by weight and more preferably from 0.001% by weight to 0.5% by weight.

The reflection type support may be a support in which a hydrophilic colloidal layer containing a white pigment is applied on the transmission type support or such reflection type support as has been prepared in the above-described manner. Further, the reflection type support may be a support which has a metal surface having specular reflection properties or second diffuse reflection properties.

Still further, as for the support for use in the photosensitive material of the invention, a white polyester type support or a support on which a layer containing a white pigment is provided, for an application of display, to the side where the silver halide emulsion layer is located. Furthermore, in order to enhance sharpness, an anti-halation layer is preferably provided either on the support to the side on which the silver halide emulsion layer is applied or on the reverse side of the support. Particularly, in order to view the display in either case of employing reflection light or transmission light, it is preferable to set transmission density of the support to be in the range of from 0.35 to 0.8.

In the photosensitive material of the invention, to enhance sharpness of images and the like, dyes (particularly, oxonol type dye) capable of being decolored by processing as described in pages 27 to 76 of EP-A No. 0,337,490 can preferably be added to the hydrophilic colloidal layer such that light reflection density of the photosensitive material becomes 0.70 or more at 680 nm, or 12% by weight (preferably 14% by weight or more) of titanium oxide in which a surface has been treated with from divalent to tetravalent alcohols (for example, trimethylol ethane) or the like can preferably be added to the water resistant resin layer of the support.

In the photosensitive material of the invention, to prevent the material from irradiation or halation and to enhance safelight safety, dyes (particularly, oxonol dyes or cyanine dyes) capable of being decolored by processing as described in pages 27 to 76 of EP-A No. 0,337,490 can be added to the hydrophilic colloidal layer. Further, dyes described in EP-A No. 0,819,977 can favorably be added to the invention. In some of these water-soluble dyes, an increase an amount of the dyes to be used may cause deterioration in color separation and safelight safety. As for the dyes which can be used without deteriorating the color separation, water-soluble dyes as described in JP-A Nos. JP-A-5-127324, 5-127325 and 5-216185 are preferably used.

According to the invention, a colored layer capable of being decolored by processing can be provided either with or without using the water-soluble dye. The colored layer may be formed in contact with an emulsion layer, either directly or via an intermediate layer containing a preventive for possible color mixture at the time of processing such as gelatin or hydroquinone. The colored layer may preferably be formed as an underlayer (a support side) of the emulsion layer forming a primary color similar to that of the colored layer. It is also possible to provide either all of respective colored layers corresponding to primary colors or a part thereof optionally selected. Further, a colored layer tinted according to a plurality of primary color regions can also be formed. As for optical reflection density of the colored layer, an optical density value at a wavelength giving highest optical density in wavelength regions to be used for exposure (a visible ray region of from 400 nm to 700 nm in a case of exposure using an ordinary printer; a wavelength of a scanning exposure source to be used in a case of scanning exposure) is preferably from 0.2 to 3.0, more preferably from 0.5 to 2.5 and most preferably from 0.8 to 2.0.

To form a colored layer, known methods can be adopted. Examples of the methods include a method of adding to the hydrophilic colloidal layer in a solid fine grain dispersion state as is found with dyes as described in from top-right column, page 3 to page 8 of JP-A No. 2-282244 or dyes as described in from top-right column, page 3 to bottom-left column, page 11 of JP-A No. 3-7931; a method of mordanting a cationic polymer by an anionic dye; a method of allowing a dye to be adsorbed to fine grains such as silver halide to fix the dye in a layer; and a method of using colloidal silver as described in JP-A No. 1-239544. To disperse fine grains of a dye in a solid state, a method of adding the fine grains which are substantially water-insoluble at least at pH 6 or less and substantially water-soluble at least at pH 8 or more is described in pages 4 to 13 of JP-A No. 2-308244. Further, for example, as for such methods of mordanting the cationic polymer by the anionic dye, a method is described in pages 18 to 26 of JP-A No. 2-84637. Still further, as for methods of preparing colloidal silver as a light absorbing agent, methods are described in U.S. Pat. Nos. 2,688,601 and 3,459,563. Among these methods, such method of allowing fine grain dye to be contained, the method of using colloidal silver and the like are preferable.

The silver halide photographic photosensitive material of the invention can be used for a color negative film, a color positive film, a color reversal film, a color reversal printing paper and the like. Among these films and the paper, the silver halide photographic photosensitive material of the invention is preferably used of the color printing paper. The color printing paper preferably comprises at least one layer each of a yellow color-forming silver halide emulsion layer, a magenta color-forming silver halide emulsion layer and a cyan color-forming silver halide emulsion layer in the order of the above-mentioned color-forming layers starting from the layer adjacent to the support.

It goes without saying that other layer constitutions than the above-described layer constitution are permissible.

The silver halide emulsion layer containing a yellow coupler may be disposed in any place on the support; however, in a case in which such yellow coupler-containing layer contains silver halide tabular grains, it is preferable to allow it to be provided in a farther position from the support than at least one of a magenta coupler-containing silver halide emulsion layer and a cyan coupler-containing silver halide emulsion layer. Further, from the standpoint of reducing color stains by color-forming development enhancement, silver removal promotion and sensitization dye, the yellow coupler-containing silver halide emulsion layer is preferably provided in a farthest position from the support than other silver halide emulsion layers. Still further, from the standpoint of reducing blix-fading, the cyan coupler-containing silver halide emulsion layer is preferably provided in the middle of other silver halide emulsion layers as an intermediate layer, while, from the standpoint of reducing light-fading, the cyan coupler-containing silver halide emulsion layer is preferably provided at the bottom of other silver halide emulsion layers as a lowest layer. Furthermore, each color-forming layer of yellow, magenta and cyan may be made of two or three layers. For example, as described in JP-A Nos. 4-75055, 9-114035 and 10-246940; U.S. Pat. No. 5,576,159; and the like, it is also preferable to provide a coupler layer which does not contain the silver halide emulsion in a position adjacent to the silver halide emulsion layer.

As the silver halide emulsions and other elements (additives and the like) to be applicable to the invention as well as photographic layer constitutions (arrangements of layers and the like), and processing methods and processing additives to be used for processing the subject photographic material, those as disclosed in JP-A Nos. 62-215272 and 2-33144; and EP-A No. 0,355,660 and, particularly, in EP-A No. 0,355,660 are preferably used. Further, silver halide color photographic photosensitive materials and processing methods thereof as disclosed in JP-A Nos. 5-34889, 4-359249, 4-313753,4-270344, 5-66527, 4-34548, 4-145433, 2-854, 1-158431, 2-90145, 3-194539 and 2-93641; and EP-A No. 0,520,457 are also preferable.

Particularly, according to the invention, reflection type supports, silver halide emulsions, hetero metal ion species to be doped in silver halide grains, storage stabilizers and antifoggants for silver halide emulsions, chemical sensitization methods (sensitizers), spectral sensitization methods (spectral sensitizers), cyan, magenta and yellow couplers and emulsify-dispersion methods thereof, color image storage improvers (anti-staining agents and fading inhibitors), dyes (colored layers), gelatin species, layer constitutions and pH of coated films of photosensitive materials are disclosed in respective places in relevant patents shown in Table 1 and are preferably applied to the present invention.

TABLE 1

| Element | JP-A7-10448 | JP-A7-77775 | JP-A7-301895 |
|---|---|---|---|
| Reflection type support | l. 12, col. 7 to l. 19, col. 12 | l. 43, col. 35 to l. 1, col. 44 | l. 40, col. 5 to l. 26, col. 9 |
| Silver halide emulsion | l. 29, col. 72 to l. 18, col. 74 | l. 36, col. 44 to l. 29, col. 46 | l. 48, col. 77 to l. 28, col. 80 |
| Hetero metal ion species | l. 19, col. 74 to l. 44, col. 74 | l. 30, col. 46 to l. 5, col. 47 | l. 29, col. 80 to l. 6, col. 81 |
| Storage stabilizer or anti-foggant | l. 9, col. 75 to l. 18, col. 75 | l. 20, col. 47 to l. 29, col. 47 | l. 11, col. 18 to l. 37, col. 31 (Particularly, mercapto heterocyclic compound) |
| Chemical sensitization (Chemical sensitizer) | l. 45, col. 74 to l. 6, col. 75 | l. 7, col. 47 to l. 17, col. 47 | l. 9, col. 81 to l. 17, col. 81 |
| Spectral sensitization (Spectral sensitizer) | l. 19, col. 75 to l. 45, col. 76 | l. 30, col. 47 to l. 6, col. 49 | l. 21, col. 81 to l. 48, col. 82 |
| Cyan coupler | l. 20, col. 12 to l. 49, col. 39 | l. 50, col. 62 to l. 16, col. 63 | l. 49, col. 88 to l. 16, col. 89 |
| Yellow coupler | l. 40, col. 87 to l. 3, col. 88 | l. 17, col. 63 to l. 30, col. 63 | l. 17, col. 89 to l. 30, col. 89 |
| Magenta coupler | l. 4, col. 88 to l. 18, col. 88 | l. 3, col. 63 to l. 11, col. 64 | l. 34, col. 31 to l. 44, col. 77 and l. 32, col. 88 to l. 46, col. 88 |
| Emulsify-dispersion method of coupler | l. 3, col. 71 to l. 11, col. 72 | l. 36, col. 61 to l. 49, col. 61 | l. 35, col. 87 to l. 48, col. 87 |
| Color image storage improver (Anti-staining agent) | l. 50, col. 39 to l. 9, col. 70 | l. 50, col. 61 to l. 49, col. 62 | l. 49, col. 87 to l. 48, col. 88 |
| Fading inhibitor | l. 10, col. 70 to l. 2, col. 71 | | |
| Dye (coloring agent) | l. 42, col. 77 to l. 41, col. 78 | l. 14, col. 7 to l. 42, col. 19 and l. 3, col. 50 to l. 14, col. 51 | l. 27, col. 9 to l. 10, col. 18 |
| Gelatin species | l. 42, col. 78 to l. 48, col. 78 | l. 15, col. 51 to l. 20, col. 51 | l. 13, col. 83 to l. 19, col. 83 |
| Layer constitution of photosensitive material | l. 11, col. 39 to l. 26, col. 39 | l. 2, col. 44 to l. 35, col. 44 | l. 38, col. 31 to l. 33, col. 32 |
| pH of coated film of photosensitive material | l. 12, col. 72 to l. 28, col. 72 | | |
| Scanning exposure | l. 6, col. 76 to l. 41, col. 77 | l. 7, col. 49 to l. 2, col. 50 | l. 49, col. 82 to l. 12, col. 83 |
| Preservative for developing solution | l. 19, col. 88 to l. 22, col. 89 | | |

As for cyan, magenta and yellow couplers used in the present invention, such couplers as described in from line 4, top-right column, page 91 to line 6, top-left column, page 121 of JP-A No. 62-215272 from line 14, top-right column, page 3 to last line, top-left column, page 18 and from line 6, top-right column, page 30 to line 11, bottom-right column, 35 page of JP-A No. 2-33144; and from line 15, page 4 to line 27, same page, from line 30, page 5 to last line, page 28, from line 29, page 45 to line 31, same page and from line 23, page 47 to line 50, page 63 of EP-A No. 0355660 are also useful.

Further, compounds represented by the general formulas (II) and (III) described in WO No. 98/33760; and the general formula (D) described in JP-A No. 10-221825 are preferable and may be added.

As for the cyan dye forming coupler ("cyan coupler" in short, as the case may be) used in the invention, a pyrrolotriazole type coupler is preferably used whereupon couplers represented by the general formulas (I) and (II) described in JP-A No. 5-313324, couplers represented by the general formula (I) described in JP-A No. 6-347960 and illustrative couplers described in these patents are particularly preferable. Further, phenolic and naphthol type cyan couples are also preferable. For example, the cyan couplers represented by the general formula (ADF) described in JP-A No. 10-333297 are preferable. As for other cyan couplers than the above-described cyan couplers, pyrroloazole type cyan couplers described in EP Nos. 0,488,248 and 0,491,197, a 2,5-diacylaminophenol coupler described in U.S. Pat. No. 5,888,716, pyrazoloazole type cyan couplers having an electron absorptive group on the 6th position and a hydrogen bonding group described in U.S. Pat. Nos. 4,873,183 and 4,916,051 and, particularly, pyrazoloazole type cyan couplers having a carbamoyl group on the 6th position described in JP-A Nos. 8-171185, 8-311360 and 8-339060 are preferable.

Further, not only diphenylimidazole type cyan couplers described in JP-A No. 2-33144, but also 3-hydroxypyridine type cyan couplers described in EP-A No. 0,333,185 (among them, a 2-equivalent coupler formed by attaching a chlorine coupling-off group to a 4-equivalent coupler of Coupler(42), as well as Couplers (6) and (9) which are cited as specific examples are preferable), cyclic active methylene type cyan couplers described in JP-A No. 64-32260 (among them, Coupler Examples 3, 8, and 34 cited as specific examples are particularly preferable), pyrrolopyrazole type cyan couplers described in EP-A No. 0,456,226, pyrroloimidazole type cyan couplers described in EP No. 0,484,909 can also be used.

Further, among these cyan couplers, pyrroloazole type cyan couplers represented by the general formula (I) described in JP-A No. 11-282138 are particularly preferable whereupon description in paragraphs [0012] to [0059] of JP-A No. 11-282138 inclusive of cyan couplers (1) to (47) cited therein are applicable to the present invention without any modification and, accordingly, incorporated in the present invention as a part thereof.

As for the magenta dye forming coupler ("magenta coupler" in short, as the case may be) used in the invention, 5-pyrazolone type magenta couplers or pyrazoloazole type magenta couplers as described in the known references shown in the above-described Table are preferably used whereupon, from the standpoint of hue, image stability, color-forming properties and the like, pyrazolotriazole couplers in which a secondary or tertiary alkyl group is directly connected to the 2nd, 3rd or 6th position of a pyrazolotriazole ring, as described in JP-A No. 61-65245; pyrazoloazole couplers containing a sulfonamido group in the molecule, as described in JP-A No. 61-65246; pyrazoloazole couplers containing an alkoxyphenylsulfonamido ballasting group, as described in JP-A No. 61-147254; and pyrazoloazole couplers containing an alkoxy group or an aryloxy group at the 6th position, as described in EP-A Nos. 226,849 and 294,785, are preferably used. Particularly, as for the magenta couplers, pyrazoloazole couplers represented by the general formula (M–1) described in JP-A No. 8-122984 are preferable and, accordingly, paragraphs [0009] to [0026] of JP-A No. 8-122984 are applicable to the present invention without any modification and incorporated to the present invention as a part thereof. Further, pyrazoloazole couplers each having a steric hindrance group at both 3rd and 6th positions, as described in EP-A Nos. 854,384 and 884,640, are also preferably used.

As for the yellow dye forming coupler ("yellow coupler" in short, as the case may be), as other compounds than those shown in the above-described Table, acylacetoamide type yellow couplers in which a 3- to 5-membered ring structure is contained in an acyl group described in EP-A No. 0,447,969; malondianilide type yellow couplers each having a ring structure described in EP-A No. 0,482,552; pyrrole-2 or 3-yl or indole-2 or 3-yl carbonylacetoanilido type couplers as described in EP-A Nos. 953,870, 953,871, 953,872, 953,873, 953,874, 953,875 and the like; and acylacetoamide type yellow couplers each having a dioxane structure disclosed in U.S. Pat. No. 5,118,599 are favorably used. Among these couplers, it is preferable to use the acylacetoamide type yellow coupler in which an acyl group is 1-alkylcyclopropane-1-carbonyl group, and the malondianilide yellow type coupler in which one of anilides forms an indoline ring. These couplers may be used either each individually or in combinations of any two or more.

Couplers used in the invention are preferably infiltrated in a loadable latex polymer(for example, U.S. Pat. No. 4,203,716) in the presence (or absence) of a high-boiling organic solvent as shown in Table 1 or dissolved together with a water-insoluble and organic solvent-soluble polymer to be emulsify-dispersed in a hydrophilic colloid aqueous solution. As for the water-insoluble and organic solvent-soluble polymers capable of being preferably used, mentioned are homopolymers or copolymers described in columns 7 to 15 of U.S. Pat. No. 4,857,449 and pages 12 to 30 of WO No. 88/00723. More preferably, use of a methacrylate type or an acrylamide type polymer and, particularly, an acrylamide type polymer therebetween are preferable from the standpoint of color image stability and the like.

According to the invention, known color mixture preventives may be used. Among them, those described in the patents mentioned below are preferable.

For example, redox compounds having a high molecular weight described in JP-A No. 5-333501, phenidone or hydrazine compounds described in WO No. 98/33760 and U.S. Pat. No. 4,923,787, white couplers described in JP-A Nos. 5-249637 and 10-282615 and GP-A No. 19,629,142 can be used. Further, particularly in a case in which pH is elevated and development is rapidly performed, redox compounds described in GP-A No. 19,618,786, EP-A Nos. 839623 and 842975, GP-A No. 19,806,846 and FP-A No. 2,760,460 are also preferably used.

According to the invention, compounds having a triazine skeleton which are high in mol absorption coefficient are preferably used as ultraviolet ray absorbing agents whereupon compounds described in the patents mentioned below can be used. These compounds are favorably added to at least one of a photosensitive layer and a non-photosensitive layer. For example, compounds described in JP-A Nos. 46-3335, 55-152776, 5-197074, 5-232630, 5-307232, 6-211813, 8-53427, 8-234364, 8-239368, 9-31067, 10-115898, 10-147577 and 10-182621; DE-A No. 19,739,797; EP-A No. 711804 and JP-W No. 8-501291 can be used.

As for binders or protective colloids used in the photosensitive materials according to the invention, use of gelatin is advantageous; however, other hydrophilic colloids than the gelatin can be used either alone or in combination with the gelatin. As for preferable gelatin, an amount of heavy metals such as iron, copper, zinc and manganese to be contained in the gelatin as impurities is preferably 5 ppm or less and more preferably 3 ppm or less. An amount of calcium to be contained in the photosensitive material is preferably 20 mg/m$^2$ or less, more preferably 10 mg/m$^2$ or less and most preferably 5 mg/m$^2$ or less.

According to the invention, in order to prevent various types of fungi or bacteria which cause deterioration of images from growing in the protective colloids, antibacterial or antifungal agents described in JP-A No. 63-271247 are preferably added. Further, pH of a film of the photosensitive material is preferably from 4.0 to 7.0 and more preferably from 4.0 to 6.5.

According to the invention, from the standpoint of enhancement of coating stability of the photosensitive material, prevention of generation of antistatic electricity, adjustment of quantity of electrostatic charge and the like, a surfactant can be added to the photosensitive material. As for such surfactants, mentioned are an anionic surfactant, a cationic surfactant, a betaine type surfactant and a nonionic surfactant. For example, those described in JP-A No. 5-333492 are mentioned. As for the surfactants used in the present invention, surfactants containing a fluorine atom are preferable. Particularly, fluorine atom-containing surfactants are favorably used. These fluorine atom-containing surfactants are used either alone or in combination with any one of other known surfactants and, between them, preferably used in combination with any one of other known surfactants. An amount of these surfactants to be used in the photosensitive material is not particularly limited, but is ordinarily from $1\times10^{-6}$ g/m$^2$ to 1 g/m$^2$, preferably from $1\times10^{-4}$ g/m$^2$ to $1\times10^{-1}$ g/m$^2$ and more preferably from $1\times10^{-3}$ g/m$^2$ to $1\times10^{-2}$ g/m$^2$.

The photosensitive material of the invention can form an image by a method comprising an exposure process in which light irradiates the photosensitive material in accordance with image information and a development process in which the thus-irradiated photosensitive material is developed.

The photosensitive material of the invention not only is used in a printer system using an ordinary negative printer but also is suitable for a scanning exposure method using a cathode ray (CRT). A cathode ray tube exposure apparatus is more convenient and compact than that which uses a laser to be low in cost and, further, can easily adjust an optical axis and color. In the cathode ray tube used for image exposure, various types of illuminants which illuminate in spectral regions can be optionally used. For example, any one, or two or more after being mixed, of a red illuminant, a green illuminant and a blue illuminant are used. The spectral regions are not limited to red, green and blue, but illuminants which illuminate in respective regions of yellow, orange, violet or infrared can be used. Particularly, the cathode ray tube in which these illuminants are mixed to illuminate in white is used in many cases.

When the photosensitive material has a plurality of photosensitive layers having different spectral sensitivity distributions from one another and the cathode ray tube has illuminants which illuminate in a plurality of spectral regions, a plurality of colors may simultaneously be exposed, or, in other words, image information of a plurality of colors may be inputted in the cathode ray tube to illuminate from a tube surface. Alternatively, a method (surface sequential exposure) in which respective image information of colors are inputted one by one to allow respective colors to illuminate one by one and perform exposure through a film which cuts other colors than the object color may be adopted whereupon ordinarily the surface sequential exposure can utilize the cathode ray tube having a high resolution; this case is preferable for obtaining an image of higher quality.

For the photosensitive material of the invention, a digital scanning exposure system using monochromatic high density light of a second harmonic generation light source (SHG) or the like in which a gas laser, a light emitting diode, a semiconductor laser or a solid state laser which uses a semiconductor laser as an excitation light source and nonlinear optical crystal are combined is favorably used. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser whereupon at least one of exposure light sources preferably uses a semiconductor laser.

When such a scanning exposure light source is used, the spectral sensitivity maximum wavelength of the photographic material of the invention can be set arbitrarily according to the wavelength of the scanning exposure light source to be used. Since oscillation wavelength of a laser can be made half using an SHG light source comprising a combination of nonlinear optical crystal with a solid state laser using a semiconductor laser as an excitation light source or a semiconductor laser, blue light and green light can be obtained. Accordingly, it is possible to have the spectral sensitivity maximum of a photographic material in normal three regions of blue, green and red. The exposure time in such a scanning exposure is defined as the time necessary to expose the size of the picture element with the density of this picture element being 400 dpi, and preferred exposure time is $10^{-4}$ second or less and more preferably $10^{-6}$ sec or less.

The silver halide color photographic photosensitive material of the invention can favorably be used in combination with exposure and development system described in known references described below. As for such development systems, mentioned are an automatic print and a development system described in JP-A No. 10-333253, a photosensitive material transportation system described in JP-A No. 2000-10206, a recording system inclusive of image reading apparatus described in 11-215312, an exposure system comprising a color image recording method described in JP-A Nos. 11-88619 and 10-202950, a digital photo print system inclusive of a remote diagnosis method described in JP-A No. 10-21020 and a photo print system inclusive of an image recording apparatus described in JP-A No. 10-159187.

Preferred scanning exposure systems which can be applied to the invention are disclosed in detail in the patents described in the above table.

When the photosensitive of the invention is subjected to a printer exposure, a band stop filter described in U.S. Pat. No. 4,880,726 is preferably used. By using such band stop filter as described above, the color mixture of light is removed to markedly enhance color reproduction.

According to the invention, as described in EP-A Nos. 0,789,270 and 0,789,480, it is permissible that a yellow microdot pattern is previously pre-exposed to perform a copy restriction thereon.

For processing the photosensitive material according to the invention, processing substances and processing methods described in from line 1, bottom-right column, page 26 to, line 9, top-right column, page of 34 JP-A No. 2-207250 and from line 17, top-left column, page 5 to line 20, bottom-right column, page 18 of JP-A No. 4-97355 can be preferably used. Further, as preservatives for use in developing solutions cited therein, compounds described in the patents described in the above table can favorably be used.

The silver halide photosensitive material containing silver halide emulsion of the invention is favorably adopted as a photosensitive material having a rapid processing aptitude. When such rapid processing is performed, a development time period for color forming is preferably 30 seconds or less, more preferably from 6 seconds to 25 seconds and still more preferably from 6 seconds to 20 seconds. Similarly, a bleach-fixing time period is preferably 30 seconds or less, more preferably from 6 seconds to 25 seconds and still more preferably from 6 seconds to 20 seconds. Further, a water-washing or stabilizing time period is preferably 60 seconds or less and more preferably from 6 seconds to 40 seconds.

Still further, the term "development time period for color forming" as used herein is intended to include a time period of from the time the photosensitive material enters a developing solution for color forming to the time the photosensitive material enters a bleach-fixing (hereinafter also referred to as "blixing") solution. For example, when the photosensitive material is processed by an automatic developing apparatus or the like, a total of a time period in which the photosensitive material is dipped in the developing solution for color forming (so-called "in-solution time period") and a time period in which the photosensitive material departed from the developing solution for color forming is transported in air to a bleach-fixing bath of a next processing step (so-called "in-air time period") is called as the development time period for color forming. In a same manner, the term "bleach-fixing time period" is intended to include a time period of from the time the photosensitive material enters the bleach-fixing solution to the time the photosensitive material enter a water-washing or stabilizing bath of next processing step. Further, the term "water-washing or stabilizing time period" is intended to include a time period in which the photosensitive material entered the water-washing or stabilizing solution stays in the solution before advancing to a next drying step (so-called "in-solution time period").

After the photosensitive material of the invention is exposed, as for developing methods, a wet method such as a method of performing development by using a developing solution comprising a conventional alkali agent and a developing primary agent and a method of first allowing the development primary agent to be contained in the photosensitive material and, then, performing development by using an activator solution, a thermal developing method which does not use any processing solution and the like can be used. Particularly in such activator method, since the processing solution does not contain the developing primary agent, control or handling of the processing solution becomes easy and load at the time of disposing waste liquid becomes small; according, the activator method is an advantageous method also from environmental safety.

In the activator method, as for such developing primary agents or precursors thereof to be contained in the photosensitive material, for example, hydrazine type compounds described in JP-A Nos. 8-234388, 9-152686, 9-152693, 9-211814 and 9-160193 are preferable.

Further, a developing method which performs image amplification processing by reducing a coating silver amount of the photosensitive material and using hydrogen peroxide can also be used. Particularly, it is preferable that this method is adopted to the activator method. Specifically, an image forming method using the activator solution containing hydroperoxide as described in JP-A Nos. 8-297354 and 9-152695 is preferably used. In the activator method, after processing is performed by the activator solution, desalting processing is ordinarily performed whereupon, in the image amplification processing method using the photosensitive material having a low silver content, an convenient method which performs only water-washing or stabilizing processing omitting the desalting processing can be used. Further, in a method in which image information is read by scanning or the like from the photosensitive material, even when the photosensitive material having a high silver content is used as in the photosensitive material for taking pictures, a processing mode which does not require the desalting processing can be adopted.

Processing substances such as the activator solution, a silver removing solution (bleaching/fixing solution) and the water-washing or stabilizing solution or processing methods can utilize known substances and methods. Preferably, those described in Research Disclosure, Item 36544, pp 536 to 541, (September, 1994) and JP-A No. 8-234388 can be used.

EXAMPLES

The following examples are given to illustrate the present invention and should not be interpreted as limiting it in any way.

Example 1

Emulsion Monolayer Sample

Preparation of Emulsion A-1

1000 ml of a 3% aqueous solution of lime-treated gelatin was adjusted so as to have a pH of 5.5 and a pC of 11.7 and, then, to the thus-adjusted solution, an aqueous solution containing 1.68 mol of silver nitrate and another aqueous solution containing 1.76 mol of sodium chloride were simultaneously added at 50° C. while stirring strongly to form a core grain. Immediately after the core grain was formed, to the resultant solution containing such core grains, 0.44 mol of silver nitrate and a halogen solution containing 0.088 mol of Br and 10.352 mol of C were simultaneously added at a constant speed for 30 minutes to form a silver bromide-containing phase. During a time period of from the time when 80% of silver nitrate was added to the time when 90% of silver nitrate was added, a $K_4[Ru(CN)_6]$ aqueous solution was added such that an Ru amount became $3\times10^{-5}$ mol per mol of finished silver halide. Further, During a time of from the time when 82% of silver nitrate was added to the time when 85% of silver nitrate was added, a $K_2[IrCl_6]$ aqueous solution was added such that an Ir amount became $5\times10^{-8}$ mol per mol of finished silver halide. Still further, during a time period of from the time when 92% of silver nitrate was added to the time when 98% of silver nitrate was added, a $K_2$[Ir(5-methylthiazole)$Cl_5$] aqueous solution was added such that an Ir amount became $1.7\times10^{-6}$ mol per mol of finished silver halide. After the resultant solution was subjected to desalting processing at 40° C., the thus-subjected solution was added with 168 g of lime-treated gelatin and, then, adjusted so as to have a pH of 5.5 and a pC of 11.8. The then-obtained grains were cubic silver bromochloride emulsion having a sphere-corresponding diameter of 0.45 $\mu$m and a fluctuation coefficient of 16%.

Further, thickness of the silver bromide-containing phase is 0.02 $\mu$m, an average Br content is about 20 mol % and a silver chloride content in entire final grains is 98 mol % (silver bromide content: 2 mol %).

The resultant emulsion was dissolved at 40° C. and, then, added with $2\times10^{-5}$ mol of sodium thiosulfonate per mol of silver halide and, thereafter, ripened at 60° C. while using sodium thiosulfate penta hydrate as a sulfur sensitizer and (S-2) as a gold sensitizer such that it became optimum. After a temperature of the resultant emulsion was lowered to 40° C., $2.7\times10^{-4}$ mole of sensitizing dye A per mol of silver halide, $1.4\times10^{-4}$ mol of sensitizing dye B per mol of silver halide, $2.7\times10^{-4}$ mol of 1-phenyl-5-mercaptotetrazole per mol of silver halide, $2.7\times10^{-4}$ mol of 1-(5-mehylureidophenyl)-5-mercaptotetrazole per mol of silver halide and $2.7\times10^{-3}$ mol of potassium bromide per mol of silver halide were added thereto to obtain an emulsion A-1.

Sensitizing dye A

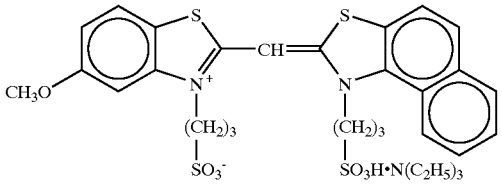

Sensitizing dye B

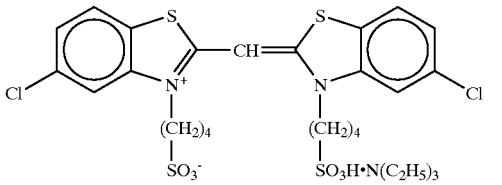

Preparation of Emulsions A-2 to A-17

In forming the silver bromide-containing phase of the emulsion A-1, an addition time and an addition temperature were changed before silver halide and the halogen solution were added and, then, a critical growth speed was obtained by measuring the addition time at which fine grains were generated by renucleation to form emulsions A-2 to A-17 which are different in a ratio of a growth speed of a high silver bromide-containing phase against the critical growth speed, and a growth temperature from one another. When distribution of silver halide contents among grains was measured, an X-ray microanalysis method was used.

TABLE 2

| Emulsion | Growth temperature | Growth speed/ Critical growth speed | Distribution of Br among grains σ/Y (Fluctuation coefficient) | Sphere-corresponding fluctuation coefficient |
|---|---|---|---|---|
| A-1 (Comparison) | 50° C. | 10% | 0.26 (26%) | 16% |
| A-2 (Comparison) | 50° C. | 40% | 0.26 (26%) | 15% |
| A-3 (Comparison) | 50° C. | 65% | 0.24 (24%) | 15% |
| A-4 (Present invention) | 50° C. | 75% | 0.17 (17%) | 12% |
| A-5 (Present invention) | 50° C. | 90% | 0.13 (13%) | 11% |
| A-6 (Comparison) | 40° C. | 65% | 0.22 (22%) | 14% |
| A-7 (Present invention) | 35° C. | 70% | 0.17 (17%) | 13% |
| A-8 (Present invention) | 30° C. | 70% | 0.15 (15%) | 12% |
| A-9 (Present invention) | 20° C. | 70% | 0.12 (12%) | 11% |
| A-10 (Present invention) | 25° C. | 90% | 0.08 (8%) | 10% |

Emulsions B-1 to B-7

In forming the silver bromide-containing phase, ratios of addition amounts of Br and Cl against the emulsion A-10 were changed, respectively to obtain emulsions B-1 to B-7 as shown in Table 3. However, thickness (grown silver amount) at the time of forming the silver bromide-containing phase was changed such that a total Br content was 4 mol %.

TABLE 3

| Emulsion | Br content of silver bromide-containing phase | Distribution of Br among grains σ/Y (Fluctuation coefficient) |
|---|---|---|
| A-10 | 20 mol % | 0.08 (8%) |
| B-1 | 13 mol % | 0.07 (7%) |
| B-2 | 16 mol % | 0.07 (7%) |
| B-3 | 23 mol % | 0.08 (8%) |
| B-4 | 25 mol % | 0.08 (8%) |
| B-5 | 30 mol % | 0.09 (9%) |
| B-6 | 34 mol % | 0.15 (15%) |
| B-7 | 38 mol % | 0.21 (21%) |

Preparation of Silver Halide Photographic Photosensitive Material

One surface of a paper support as laminated with a polyethylene resin on both surfaces thereof was corona-discharged, and a gelatin subbing layer containing sodium dodecylbenzene sulfonate was provided thereon. Further, first and second photographic constitutional layers were coated thereon in order to prepare samples of silver halide color photographic photosensitive materials having respective layer constitutions as described below. Coating solutions for respective photographic photosensitive layers were prepared as described below.

Preparation of First Coating Solution 57 g of yellow coupler (ExY-1), 7 g of color image stabilizer (Cpd-1), 4 g of color image stabilizer (Cpd-2), 7 g of color image stabilizer (Cpd-3) and 2 g of color image stabilizer (Cpd-8) were dissolved in 21 g of solvent (Solv-1), 80 cc of ethyl acetate and, then, the resulting solution was added to 220 g of a 23.5% by weight aqueous solution of gelatin containing 4 g of sodium dodecylbenzene sulfonate and emulsify-dispersed by a high speed mix-emulsifying device (dissolver) and, then, added with water to obtain 900 g of an emulsified dispersion A.

On the other hand, the emulsified dispersion A and emulsion B-1 were mix-dissolved to prepare a coating liquid for the first layer. A coating amount of silver halide emulsion is given by that in terms of silver amount.

A coating solution for a second layer was prepared in a same manner as in the first layer. As for gelatin hardeners for each layer, 1-oxy-3,5-dichloro-s-triazine sodium salt (H-1), (H-2) and (H-3) were used. Further, to each layer, Ab-1, Ab-2, Ab-3 and Ab-4 were added such that entire amounts thereof became 15.0 mg/m$^2$, 60.0 mg/m$^2$, 5.0 mg/M$^2$ and 10.0 mg/m$^2$, respectively.

70:30 mixture (molar ratio) of (ExY-1) Yellow coupler

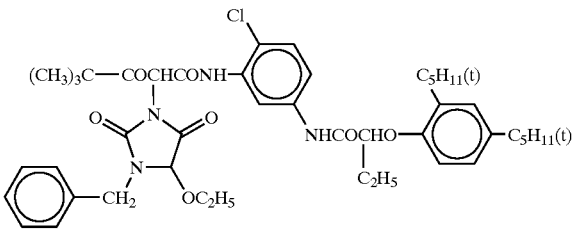

and

-continued

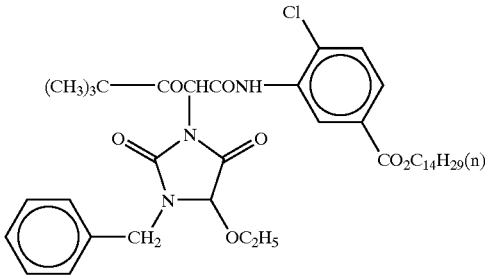

(Cpd-1) Color image stabilizer

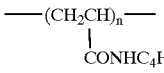

Number average molecular weight: 60,000

(Cpd-2) Color image stabilizer

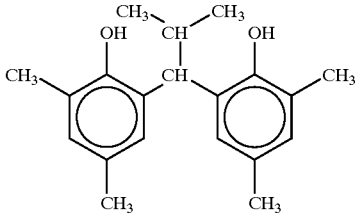

(Cpd-3) Color image stabilizer

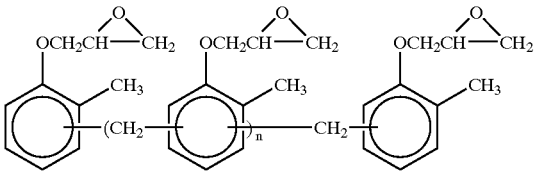

n = 7 to 8 (Average value)

(Cpd-8) Color image stabilizer

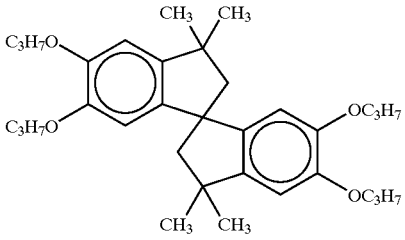

Solv-1

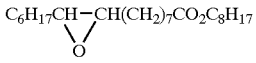

(H-1) Film hardener

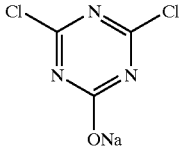

(amount used: 1.4% per gelatin (by weight))

(H-2) Film hardener

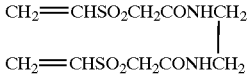

-continued (H-3) Film hardener

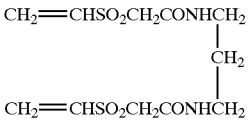

(Ab-1) Antiseptic agent

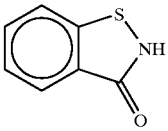

(Ab-2) Antiseptic agent

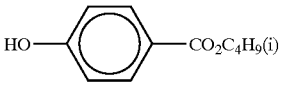

(Ab-3) Antiseptic agent

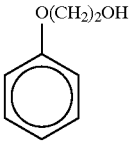

(Ab-4) Antiseptic agent (1:1:1:1 mixture (molar ratio) of a, b, c and d)

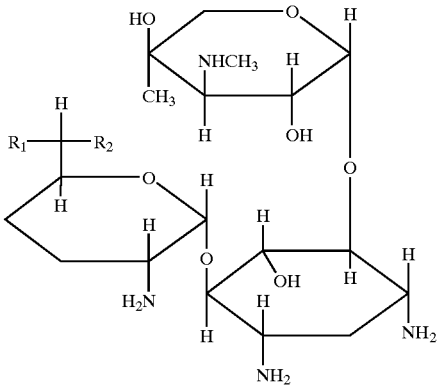

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Layer Constituion

Constitutions of respective layers are described below. Numerals identify the coating amount ($g/m^2$). The coating amount of the silver halide emulsion is given by that in terms of silver amount.

Support:

Paper Laminated with a Polyethylene Resin (A white pigment ($TiO_2$; content: 16% by weight, ZnO; content: 4% by weight), a fluorescent whitening agent (4,4'-bis(5-methylbenzoxazolyl)stilbene; content: 0.03% by weight) and blue-tint dye (ultramarine blue) are contained in the polyethylene resin on the first layer side.)

| First Layer (Blue-Sensitive Emulsion Layer) | |
|---|---|
| Emulsion | 0.26 |
| Gelatin | 1.25 |
| Yellow coupler (ExY-1) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second Layer (Protective Layer) | |
| Gelatin | 1.00 |
| Copolymer of polyvinyl alcohol denatured with acryl (denaturation rate: 17%) | 0.04 |
| Liquid paraffin | 0.02 |
| Surfactant (Cpd-13) | 0.01 |

Such sample as obtained above is designated as a sample 101. Samples 102 to 107 were prepared in a same manner as in the sample 101 except that an emulsifying agent in an emulsion layer of each sample was changed.

Sensitometry Evaluation

In order to evaluate photographic characteristics of these samples, tests as described below were performed thereon. Each sample was subjected to gradation exposure for sensitometry by using a high intensity exposure sensitometer (HIE TYPE; manufactured by Yamashita Denso Corporation) and a standard intensity sensitometer(tungsten light source). The exposure time periods applied were 10 seconds, 1/10 second, $10^{-4}$ second. As the filter, a blue filter was used. After the samples were exposed, they were subjected to development processing for color forming A.

Processing steps are shown below.

Processing A

Samples of the above-described photosensitive material were processed in a roll form having a width of 127 mm and, then, was exposed imagewise by using a minilab-printer/processor (trade name: PR1258AR; manufactured by Fuji Photo Film Co., Ltd.) and, thereafter, subjected to a running test by processing steps described below until replenishments reach two times the capacity of a color development processing. Such processing as using a running solution was designated as processing A.

| Processing steps | Temperature | Time | Replenishment |
|---|---|---|---|
| Color development | 38.5° C. | 45 second | 45 ml |
| Bleach-fixing | 38.0° C. | 45 second | 35 ml |
| Rinse (1) | 38.0° C. | 20 second | — |
| Rinse (2) | 38.0° C. | 20 second | — |
| Rinse (3) | **38.0° C. | 20 second | — |
| Rinse (4) | **38.0° C. | 30 second | 121 ml |

*Replenishment per 1 $m^2$ of photosensitive material
**Manufactured by Fuji Photo Film Co., Ltd.

A rinse-cleaning system (trade name: RC50D; manufactured by Fuji Photo Film Co., Ltd.) was attached to a rinse (3) and, then, a rinse solution was taken from the rinse (3) and, thereafter, the thus-taken rinse solution was sent to a reverse osmosis module (RC50D). The resultant infiltrated water therefrom was supplied to a rinse (4) and condensed water was returned to the rinse (3). A pump pressure was adjusted such that an amount of water to be supplied to the reverse osmosis module for infiltration was maintained at from 30 ml/minute to 50 ml/minute and the rinse solution was circulated for 10 hours a day under a temperature control.

(Rinse was performed by a 4-tank (from tank (1) through tank (4)) counter-current flow system.

Compositions of respective processing solutions are shown below.

| | [Tank solution] | [Replenishing solution] |
|---|---|---|
| [Color developing solution] | | |
| Water | 800 ml | 800 ml |
| Dimethyl polysiloxane type surfactant (trade name: Silicone KF351A; manufactured by Shin-Etsu Chemical Co., Ltd.) | 0.1 g | 0.1 g |
| Tri(isopropanol)amine | 8.8 g | 8.8 g |
| Ethylene diamine tetraacetic acid | 4.0 g | 4.0 g |
| polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinyl aminostilbene type fluorescent whitening agent (trade name: Hakkol FWA-SF; manufactured by Showa Kagaku Kogyo K.K.) | 2.5 g | 5.0 g |
| Sodium sulfite | 0.1 g | 0.1 g |
| Disodium-N,N-bis(sulfonatoethyl)hydroxylamine | 8.5 g | 11.1 g |
| N-ethyl-N-(β-methane sulfonamide ethyl)-3-methyl-4-amino-4-aminoaniline · 3/2 sulfuric acid · monohydrate | 5.0 g | 15.7 g |
| Calcium carbonate | 26.3 g | 26.3 g |
| Made up to with water | 1000 ml | 1000 ml |
| pH (25° C.; adjusted by potassium hydroxide and sulfuric acid) | 10.15 | 12.50 |
| [Bleach-fixing solution] | | |
| Water | 700 ml | 600 ml |
| Ethylene diamine tetraacetic acid iron (III) ammonium | 47.0 g | 94.0 g |
| Ethylene diamine tetraacetic acid | 1.4 g | 2.8 g |
| m-carboxybenzene sulfinic acid | 8.3 g | 16.5 g |
| Nitric acid | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Made up to with water | 1000 ml | 1000 ml |
| pH (25° C.; adjusted by acetic acid and ammonia) | 6.0 | 6.0 |
| [Rinse solution] | | |
| Sodium chloroisocyanurate | 0.02 g | 0.02 g |
| Deionized water (Electric conductivity: 5 μS/cm or less) | 1000 ml | 1000 ml |
| pH | 6.5 | 6.5 |

Yellow-forming density of each sample after being processed was measured to obtain a characteristic curve of each illuminance. Sensitivity (S) is expressed by an antilog of an inverse number of exposure quantity which gives a color-forming density 0.7 higher than a minimum color-forming density and light quantity calibration was performed at each illuminance and expressed in a relative value when 1/10 sensitivity of the sample 101 was set as 100. As the value is larger, the sensitivity becomes higher and favorable. Gradation was determined in accordance with an inclination of a direct line between densities of 1.0 and 2.0 at the time of exposure of 1/10 second. As the value is larger, contrast becomes higher and favorable. The results are shown in Table 4.

TABLE 4

| Sample | Emulsion | Gradation | Sensitivity (10 seconds) | Sensitivity (1/10 second) | Sensitivity ($10^{-4}$ second) |
|---|---|---|---|---|---|
| 101 | A-1 | 2.1 | 80 | 100 | 50 |
| 102 | A-2 | 2.0 | 80 | 105 | 60 |
| 103 | A-3 | 2.2 | 90 | 95 | 60 |
| 104 | A-4 | 2.5 | 100 | 110 | 100 |
| 105 | A-5 | 2.7 | 120 | 120 | 110 |
| 106 | A-6 | 2.2 | 80 | 95 | 70 |
| 107 | A-7 | 2.5 | 110 | 110 | 105 |
| 108 | A-8 | 2.6 | 120 | 120 | 130 |
| 109 | A-9 | 2.8 | 125 | 120 | 130 |
| 110 | A-10 | 3.0 | 140 | 140 | 145 |
| 111 | B-1 | 3.1 | 100 | 105 | 100 |
| 112 | B-2 | 3.0 | 120 | 125 | 120 |
| 113 | B-3 | 3.0 | 130 | 140 | 140 |
| 114 | B-4 | 3.0 | 160 | 160 | 170 |
| 115 | B-5 | 3.0 | 170 | 170 | 170 |
| 116 | B-6 | 2.8 | 135 | 150 | 145 |
| 117 | B-7 | 2.0 | 120 | 140 | 130 |

As is apparent from the results in Table 4, the samples of the invention has a high sensitivity at all illuminance and high contrast whereby it was confirmed that the samples were excellent.

Example 2

Preparation of Emulsion C-1(Trisoctahedron Core Emulsion)

1000 ml of a 3% aqueous solution of lime-treated gelatin was adjusted so as to have a pH of 5.5 and a pC of 11 and, then, to the thus-adjusted solution, an aqueous solution containing 0.212 mol of silver nitrate and another aqueous solution containing 0.2 mol of sodium chloride were simultaneously added at 45° C. while stirring strongly. Subsequently, to the resultant solution, an aqueous solution containing 1.68 mol of silver nitrate and sodium chloride were added at 33° C. by a flow rate acceleration method to allow grains to be grown at 70% to 85% of a critical growth speed under a condition of addition of an entire quantity thereof. At this time potential was controlled to be constant by a control double jet method. The resultant core emulsion contains trisoctahedral grains having 0.31 μm of sphere-corresponding diameter, 10% of fluctuation coefficient thereof and occupying 86% of an entire projected area.

Thereafter, a temperature of the core emulsion was elevated to 40° and, then, the emulsion was added with a silver halide solution containing 0.44 mol of silver nitrate, 0.088 mol of Br and 0.352 mol of Cl at the same temperature and at 40% of the critical growth speed to form a silver bromide phase.

Further, during a time period of from the time when 80% of silver nitrate was added to the time when 90% of silver nitrate was added, a $K_4$ [Ru $(CN)_6$] aqueous solution was added such that an Ru amount became $3\times10^{-5}$ mol per mol of finished silver halide. Further, during a time period of from the time when 83% of silver nitrate was added to the time when 88% of silver nitrate amount was added, a $K_2[IrCl_6]$ aqueous solution was added such that an Ir amount became $5\times10^{-8}$ mol per mol of finished silver halide. Still further, during a time period when 92% of silver nitrate was added to the time when 95% of silver nitrate was added, a $K_2$[Ir(5-methylthiazole)$Cl_5$] aqueous solution was added such that an Ir amount became $5\times10^{-7}$ mol per mol of finished silver halide. Furthermore, during a time period of from the time when 95% of silver halide was added to the time when 98% of the silver halide was added, a $K_2[Ir(H_2O)Cl_5]$ aqueous solution was added such that an Ir amount became $5\times10^{-7}$ mol per mol of finished silver halide. After the resultant solution was subjected to desalting processing at 40° C., the thus-subjected solution was added with 168 g of lime-treated gelatin and, then, adjusted so as to have a pH of 5.5 and a pC of 11.8. The then-obtained grains were cubic silver chloride emulsion having a sphere-corresponding diameter of 0.35 μm and a fluctuation coefficient of 10%.

The resultant emulsion was dissolved at 40° C. and, then, added with $2\times10^{-5}$ mol of sodium thiosulfonate per mol of silver halide and, thereafter, ripened at 60° C. while using sodium thiosulfate-penta hydrate as a sulfur sensitizer and (S-2) as a gold sensitizer such that it became optimum. After a temperature of the resultant emulsion was lowered to 40° C., $6\times10^{-4}$ mole of sensitizing dye D per mol of silver halide, $2\times10^{-4}$ mol of 1-phenyl-5-mercaptotetrazole per mol of silver halide, $8\times10^{-4}$ mol of 1-(5-mehylureidophenyl)-5-mercaptotetrazole per mol of silver halide and $7\times10^{-3}$ mol of potassium bromide per mol of silver halide were added thereto to obtain an emulsion C-1. At the time 90% of an addition of silver nitrate to the thus-obtained emulsion C-1 was completed, a potassium iodide aqueous solution was further added to the resultant emulsion C-1 while strongly stirring such that an I amount became from 0.1 mol to 0.6 mol per mol of finished silver halide to obtain emulsions C-2 to C-6.

Sensitizing dye D

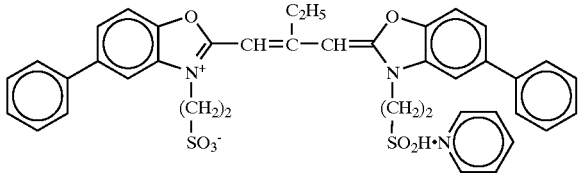

Preparation of Emulsion D-1 (Cubic Core Emulsion)

1000 ml of a 3% aqueous solution of lime-treated gelatin was adjusted so as to have a pH of 5.5 and a pC of 11.7 and, then, to the thus-adjusted solution, an aqueous solution containing 2.12 mol of silver nitrate and another aqueous solution containing 2.2 mol of sodium chloride were simultaneously added at 45° C. while stirring strongly. When an addition amount of silver nitrate became 73% of an entire silver nitrate amount to be added, a potassium iodide ion was added in an amount corresponding to 0.2 mol % of a final silver amount to be added. Although it took 50 minutes to add 80% of silver nitrate, it took one minute to add potassium iodide.

During a time period of from the time when 80% of silver nitrate was added to the time when 100% of silver nitrate was added, potassium bromide was added while strongly stirring such that the amount thereof became 4.3 mol % per mol of silver halide. Growth at the time potassium bromide was added was performed in 40% of the critical growth speed and the temperature was set to be 40° C. At this time, the growth speed performed at 80% of the critical growth speed. During a time period of from the time when 80% of silver nitrate was added to the time when 90% of silver nitrate was added, a $K_4[Ru(CN)_6]$ aqueous solution was added such that an Ru amount became $3\times10^{-5}$ mol per mol of finished silver halide. During a time period of from the time when 80% of silver nitrate was added to the time when 90% of silver nitrate was added, a $K_4[Ru(CN)_6]$ aqueous solution was added such that an Ru amount became $3\times10^{-5}$ mol per mol of finished silver halide. During a time period of from the time when 83% of silver nitrate was added to the time when 88% of silver nitrate was added, a $K_2[IrCl_6]$ aqueous solution was added such that an Ir amount became $5\times10^{-8}$ mol per mol of finished silver halide. During a time period of from the time when 92% of silver nitrate was added to the time when 95% of silver nitrate was added, a $K_2[Ir(5\text{-methylthiazole})Cl_5]$ aqueous solution was added such that an Ir amount became $5\times10^{-7}$ mol per mol of finished silver halide. Further, during a time period of from the time when 95% of silver halide was added to the time when 98% of silver nitrate was added, a $K_2[Ir(H_2O)Cl_5]$ aqueous solution was added such that an Ir amount became $5\times10^{-7}$ mol per mol of finished silver halide. After the resultant solution was subjected to desalting processing at 40° C., the thus-subjected solution was added with 168 g of lime-treated gelatin and, then, adjusted so as to have a pH of 5.5 and a pC of 11.8. The then-obtained grains were cubic silver iodobromochloride emulsion having a sphere-corresponding diameter of 0.35 μm and a fluctuation coefficient of 10%.

The resultant emulsion was dissolved at 40° C. and, then, added with $2\times10^{-5}$ mol of sodium thiosulfonate per mol of silver halide and, thereafter, ripened at 60° C. while using sodium thiosulfate penta hydrate as a sulfur sensitizer and (S-2) as a gold sensitizer such that it became optimum. After a temperature of the resultant emulsion was lowered to 40° C., $2\times10^{-4}$ mole of sensitizing dye H per mol of silver halide, $2\times10^{-4}$ mol of 1-phenyl-5-mercaptotetrazole per mol of silver halide, $8\times10^{-4}$ mol of 1-(5-mehylureidophenyl)-5-mercaptotetrazole per mol of silver halide $1\times10^{-3}$ mol of Compound I per mol of silver halide and $7\times10^{-3}$ mol of potassium bromide per mol of silver halide were added thereto to obtain an emulsion D-1. By changing the addition amount of potassium iodide ion as shown in Table 5, emulsions D-2 to D-6 were obtained.

Sensitizing dye H

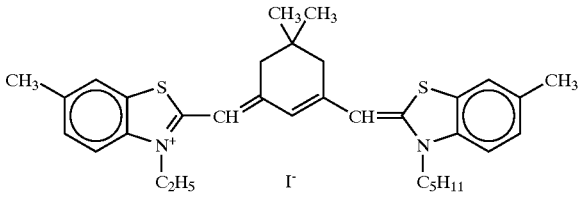

Compound I

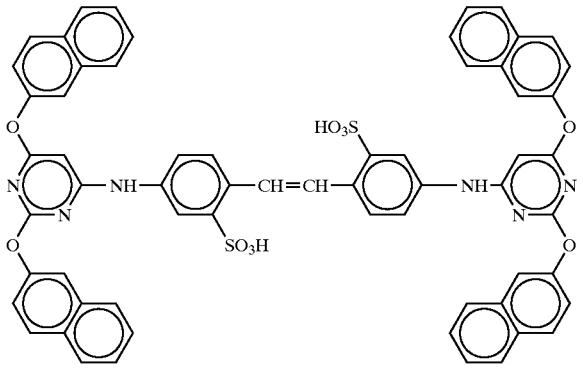

TABLE 5

| Emulsion | Core shape | Iodide content | Distribution of Br among grains σ/Y (Fluctuation coefficient) |
|---|---|---|---|
| C-1 (Present invention) | Trisoctahedron | 0 | 0.12 (12%) |
| C-2 (Present invention) | Trisoctahedron | 0.1 | 0.14 (14%) |
| C-3 (Present invention) | Trisoctahedron | 0.2 | 0.15 (15%) |
| C-4 (Present invention) | Trisoctahedron | 0.35 | 0.17 (17%) |
| C-5 (Comparison) | Trisoctahedron | 0.45 | 0.19 (19%) |
| C-6 (Comparison) | Trisoctahedron | 0.60 | 0.20 (20%) |
| D-1 (Comparison) | Cube | 0 | 0.23 (23%) |
| D-2 (Present invention) | Cube | 0.1 (Core) | 0.14 (14%) |
| D-3 (Present invention) | Cube | 0.2 (Core) | 0.13 (13%) |
| D-4 (Present invention) | Cube | 0.35 (Core) | 0.12 (12%) |
| D-5 (Present invention) | Cube | 0.45 (Core) | 0.18 (18%) |
| D-6 (Comparison) | Cube | 0.60 (Core) | 0.19 (19%) |

By using the thus-prepared emulsions, coated substances similar to those in Example 1 were prepared and, then, subjected to a sensitometry evaluation. It was confirmed that the emulsions of the invention has high sensitivity and high contrast particularly at high illuminance.

Example 3

Multi-Layer Type Sample

One surface of a paper support as laminated with a polyethylene resin on both surfaces thereof was corona-discharged, and a gelatin subbing layer containing sodium dodecylbenzene sulfonate was provided thereon. Further, first to 7th photographic constitutional layers were coated thereon in order to prepare samples of silver halide color photographic photosensitive materials having respective layer constitutions as described below. Coating solutions for respective photographic photosensitive layers were prepared as described below.

Preparation of First Coating Solution 57 g of yellow coupler (ExY-1), 7 g of color image stabilizer (Cpd-1), 4 g of color image stabilizer (Cpd-2), 7 g of color image stabilizer (Cpd-3) and 2 g of color image stabilizer (Cpd-8) were dissolved in 21 g of solvent (Solv-1) 80 cc of ethyl acetate and, then, the resulting solution was added to 220 g of a 23.5% by weight aqueous solution of gelatin containing 4 g of sodium dodecylbenzene sulfonate and emulsify-dispersed by a high speed mix-emulsifying device (dissolver) and, then, added with water to obtain 900 g of an emulsified dispersion A.

On the other hand, the emulsified dispersion A and emulsion A-1 were mix-dissolved to prepare a coating liquid for the first layer. A coating amount of silver halide emulsion is given by that in terms of silver amount.

Preparation of Emulsion G-1

1000 ml of a 3% aqueous solution of lime-treated gelatin was adjusted so as to have a pH of 5.5 and a pC of 11.7 and, then, to the thus-adjusted solution, an aqueous solution containing 2.12 mol of silver nitrate and another aqueous solution containing 2.2 mol of sodium chloride were simultaneously added at 45° C. while stirring strongly. During a time period of from the time when 80% of silver nitrate was added to the time when 90% of silver nitrate was added, a $K_4[Ru(CN)_6]$ aqueous solution was added such that an Ru amount became $3\times10^{-5}$ mol per mol of finished silver halide. During a time period of from the time when 83% of silver nitrate was added to the time when 88% of silver nitrate was added, a $K_2[IrCl_6]$ aqueous solution was added such that an Ir amount became $5\times10^{-8}$ mol per mol of finished silver halide. During a time period of from the time when 92% of silver nitrate was added to the time when 95% of silver nitrate was added, a $K_2[Ir(5\text{-methylthiazole})Cl_5]$ aqueous solution was added such that an Ir amount became $5\times10^{-7}$ mol per mol of finished silver halide. Further, during a time period of from the time when 95% of silver halide was added to the time when 98% of silver nitrate was added, a $K_2[Ir(H_2O)Cl_5]$ aqueous solution was added such that an Ir amount became $5\times10^{-7}$ mol per mol of finished silver halide. After the resultant solution was subjected to desalting processing at 40° C., the thus-subjected solution was added with 168 g of lime-treated gelatin and, then, adjusted so as to have a pH of 5.5 and a pC of 11.8. The then-obtained grains were silver halide emulsion in which almost 100% of the projected area is occupied by cubic silver chloride grains having a sphere-corresponding diameter of 0.35 μm and a fluctuation coefficient of 10%.

The resultant emulsion was dissolved at 40° C. and, then, added with $2\times10^{-5}$ mol of sodium thiosulfonate per mol of silver halide and, thereafter, ripened at 60° C. while using sodium thiosulfate penta hydrate as a sulfur sensitizer and (S-2) as a gold sensitizer such that it became optimum. After a temperature of the resultant emulsion was lowered to 40° C., $6\times10^{-4}$ mole of sensitizing dye D per mol of silver halide, $2\times10^{-4}$ mol of 1-phenyl-5-mercaptotetrazole per mol of silver halide, $8\times10^{-4}$ mol of 1-(5-mehylureidophenyl)-5-mercaptotetrazole per mol of silver halide and $7\times10^{-3}$ mol of potassium bromide per mol of silver halide were added thereto to obtain an emulsion G-1.

Preparation of Emulsion R-1

1000 ml of a 3% aqueous solution of lime-treated gelatin was adjusted so as to have a pH of 5.5 and a pC of 11.7 and, then, to the thus-adjusted solution, an aqueous solution containing 2.12 mol of silver nitrate and another aqueous solution containing 2.2 mol of sodium chloride were simultaneously added at 45° C. while stirring strongly. During a time period of from the time when 80% of silver nitrate was added to the time when 100% of silver nitrate was added, a potassium bromide was added such that an amount thereof became 4 mol % per mol of finished silver halide. During a time period of from the time when 80% of silver nitrate was added to the time when 90% of silver nitrate was added, a $K_4[Ru(CN)_6]$ aqueous solution was added such that an Ru amount became $3\times10^{-5}$ mol per mol of finished silver halide. During a time period of from the time when 83% of silver nitrate was added to the time when 88% of silver nitrate was added, a $K_2[IrCl_6]$ aqueous solution was added such that an Ir amount became $5\times10^{-8}$ mol per mol of finished silver halide. At the time an addition of 90% of silver nitrate was finished, potassium iodide was added while stirring strongly such that an amount thereof became 0.1 mol % per mol of finished silver halide. During a time period of from the time when 92% of silver nitrate was added to the time when 95% of silver nitrate was added, a $K_2[Ir(5\text{-methylthiazole})Cl_5]$ aqueous solution was added such that an Ir amount became $5\times10^{7}$ mol per mol of finished silver halide. Further, during a time period of from the time when 95% of silver halide was added to the time when 98% of silver halide was added, a $K_2[Ir(H_2O)Cl_5]$ aqueous solution was added such that an Ir amount became $5\times10^{-7}$ mol per mol of finished silver halide. After the resultant solution was subjected to desalting processing at 40° C., the thus-subjected solution was added with 168 g of lime-treated gelatin and, then, adjusted so as to have a pH of 5.5 and a pC of 11.8. The resultant silver halide emulsion was such that the obtained grains occupy almost 100% of an entire projected area of cubic silver iodobromochloride grains having a sphere-corresponding diameter of 0.35 μm and a fluctuation coefficient of 10%.

The resultant emulsion was dissolved at 40° C. and, then, added with $2\times10^{-5}$ mol of sodium thiosulfonate per mol of silver halide and, thereafter, ripened at 60° C. by using sodium thiosulfate penta hydrate as a sulfur sensitizer and (S-2) as a gold sensitizer such that it became optimum. After a temperature of the resultant emulsion was lowered to 40° C., $2\times10^{-4}$ mole of sensitizing dye H per mol of silver halide, $2\times10^{-4}$ mol of 1-phenyl-5-mercaptotetrazole per mol of silver halide, $8\times10^{-4}$ mol of 1-(5-mehylureidophenyl)-5-mercaptotetrazole per mol of silver halide, $1\times10^{-3}$ mol of Compound I per mol of silver halide $7\times10^{-3}$ mol of potassium bromide per mol of silver halide were added thereto to obtain an emulsion R-1.

Coating solutions for the second layer to the 7th layer were prepared in a same manner as in the coating solution fo the first layer. As for gelatin hardeners for each layer, 1-oxy-3,5-dichloro-s-triazine sodium salt (H-1), (H-2) and (H-3) were used. Further, to each layer, Ab-1, Ab-2, Ab-3 and Ab-4 were added such that entire amounts thereof became 15.0 mg/m$^2$, 60.0 mg/m$^2$, 5.0 mg/m$^2$ and 10.0 mg/m$^2$, respectively.

Further, to a green sensitive emulsion layer and a red sensitive emulsion layer, $1.0\times10^{-3}$ mol and $5.9\times10^{-4}$ mol of 1-phenyl-5-mercaptotetrazole were added per mol of silver halide, respectively. Further, also to the 2nd, 4th and 6th layers, 0.2 mg/m$^2$, 0.2 mg/m$^2$ and 0.6 mg/m$^2$ of 1-phenyl-5-mercaptotetrazole were added, respectively.

To the red sensitive emulsion layer, added were 0.05 g/m$^2$ of a copolymer latex of methacrylic acid and butyl acrylate (1:1 in ratio by weight; average molecular weight: 200000 to 400000). Further, to the 2nd, 4th and 6th layers, added were 6 mg/m$^2$, 6 mg/m$^2$ and 18 mg/m$^2$ of disodium catechol-3, 5-disulfonate, respectively. Still further, for preventing irradiation, dyes described below were added (numerals in parentheses show respective coating amounts).

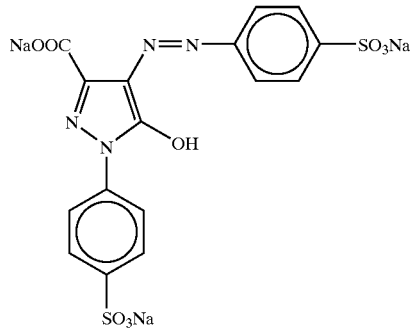

(2 mg/m$^2$)

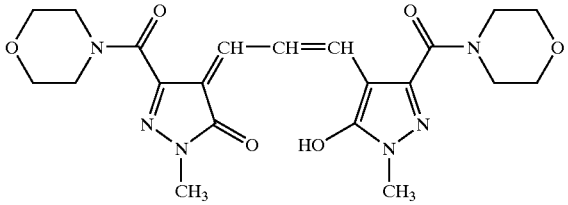

(2 mg/m$^2$)

-continued

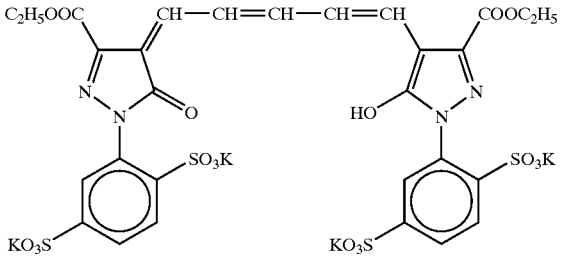

(3 mg/m$^2$)

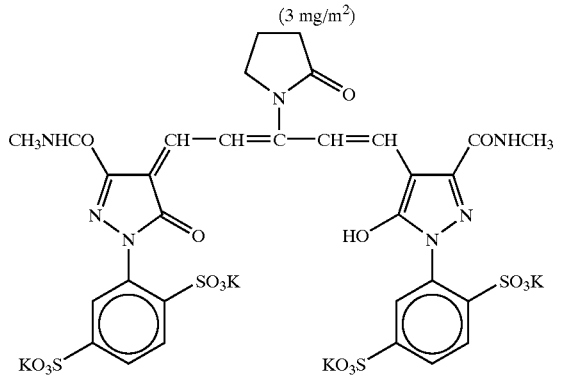

(7 mg/m$^2$)

Layer Constitution

Constitutions of respective layers are described below. Numerals identify the coating amount (g/m$^2$). The coating amount of the silver halide emulsion is given by that in terms of silver amount.

Support:

Paper Laminated with a Polyethylene Resin (A white pigment ($TiO_2$; content: 16% by weight, ZnO; content: 4% by weight) and a fluorescent whitening agent (4,4'-bis(5-methylbenzoxazolyl)stilbene; content: 0.03% by weight) inclusive of blue-tint dye (ultramarine blue) are contained in the polyethylene resin on the first layer side.)

| | |
|---|---|
| First Layer (Blue-Sensitive Emulsion Layer) | |
| Emulsion A-1 | 0.26 |
| Gelatin | 1.25 |
| Yellow coupler (ExY-1) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second Layer (Color Mixture Preventive Layer) | |
| Gelatin | 0.99 |
| Color mixture inhibitor (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| Third Layer (Green-Sensitive Emulsion Layer) | |
| Emulsion G-1 | 0.15 |
| Gelatin | 1.36 |
| Magenta coupler (ExM) | 0.15 |
| UV ray absorbing agent (UV-A) | 0.14 |
| Color image stabilizer (Cpd-2) | 0.02 |

-continued

| | |
|---|---|
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color Mixture Preventive Layer) | |
| Gelatin | 0.71 |
| Color mixture inhibitor (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| Fifth Layer (Red-Sensitive Emulsion Layer) | |
| Emulsion R-1 | 0.13 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| Sixth Layer (UV Ray Absorbing Layer) | |
| Gelatin | 0.46 |
| UV ray absorbing agent (UV-B) | 0.45 |
| Compound (S1-4) | 0.0015 |
| Solvent (Solv-7) | 0.25 |
| Seventh Layer (Protective Layer) | |
| Gelatin | 1.00 |
| Copolymer of polyvinyl alcohol denatured with acryl (denaturation rate: 17%) | 0.04 |
| Liquid paraffin | 0.02 |
| Surfactant (Cpd-13) | 0.01 |

The sample obtained above was designated as sample 201. Another sample was prepared in a same manner as described above except that the emulsion in the blue-sensitive emulsion layer was changed into the emulsion of the invention prepared in Examples 1 and 2.

In order to evaluate photographic characteristics of these samples, these samples were subjected to tests described below.

Each sample was subjected to $10^{-6}$ second high intensity gradation exposure for sensitometry for gray color forming by using a high intensity exposure sensitometer(trade name: HIE TYPE; manufactured by Yamashita Denso Corporation).

After the samples were exposed, they were subjected to development processing for color forming A in a same manner as in Examples 1 and 2.

Yellow forming density of each sample after being processed was measured to obtain a characteristic curve of each $10^{-6}$ second high intensity exposure. Sensitivity (S) is expressed by an antilog of an inverse number of exposure quantity which gives a color-forming density 0.7 higher than a minimum color-forming density and light quantity calibration was performed at each illuminance and expressed in a relative value when the sensitivity of the sample 201 was set as 100. As the value is larger, the sensitivity becomes higher and favorable. Gradation (γ) was determined in accordance with an inclination of a direct line between densities of 1.0 and 2.0. As the value is larger, contrast becomes higher and favorable. Since the sample of the invention has a high sensitivity in the yellow color-forming layer and shows a high contrast, the sample was found to be excellent.

Example 4

Multi-Layer Sample for Rapid Processing

A sample 111 was prepared in a thinner state than the sample 201 of Example 3 by changing the photographic constitution layers as described below.

| | |
|---|---|
| First Layer (Blue-Sensitive Emulsion Layer) | |
| Emulsion A-10 | 0.14 |
| Gelatin | 0.75 |
| Yellow coupler (ExY-2) | 0.34 |
| Color image stabilizer (Cpd-1) | 0.04 |
| Color image stabilizer (Cpd-2) | 0.02 |
| Color image stabilizer (Cpd-3) | 0.04 |
| Color image stabilizer (Cpd-8) | 0.01 |
| Solvent (Solv-1) | 0.13 |
| Second Layer (Color Mixture Preventive Layer) | |
| Gelatin | 0.60 |
| Color mixture inhibitor (Cpd-19) | 0.09 |
| Color image stabilizer (Cpd-5) | 0.007 |
| Color image stabilizer (Cpd-7) | 0.007 |
| UV ray absorbing agent (UV-C) | 0.05 |
| Solvent (Solv-5) | 0.11 |
| Third Layer (Green-Sensitive Emulsion Layer) | |
| Emulsion G-1 | 0.14 |
| Gelatin | 0.73 |
| Magenta coupler (ExM) | 0.15 |
| UV ray absorbing agent (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color Mixture Preventive Layer) | |
| Gelatin | 0.48 |
| Color mixture inhibitor (Cpd-4) | 0.07 |
| Color image stabilizer (Cpd-5) | 0.006 |
| Color image stabilizer (Cpd-7) | 0.006 |
| UV ray absorbing agent (UV-C) | 0.04 |
| Solvent (Solv-5) | 0.09 |
| Fifth Layer (Red-Sensitive Emulsion Layer) | |
| Emulsion R-1 | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| UV ray absorbing agent (UC-7) | 0.02 |
| Solvent (Solv-5) | 0.09 |
| Sixth Layer (UV Ray Absorbing Layer) | |
| Gelatin | 0.32 |
| UV ray absorbing agent (UV-C) | 0.42 |
| Solvent (Solv-7) | 0.08 |

-continued

| | |
|---|---|
| Seventh Layer (Protective Layer) | |
| Gelatin | 0.70 |
| Copolymer of polyvinyl alcohol denatured with acryl (denaturation rate: 17%) | 0.04 |
| Liquid paraffin | 0.01 |
| Surfactant (Cpd-13) | 0.01 |
| Polydimethylsilxane | 0.01 |
| Silicon dioxide | 0.003 |

The thus-obtained sample was designated as sample 301. Further, a multi-layer coated sample was prepared by changing the emulsion in the blue-sensitive layer into the halogenated emulsion prepared in Example 1 or 2 of the invention.

In order to evaluate photographic characteristics of these samples by laser-scanning exposure, tests as described below were performed as described below.

As for laser light sources, a blue semiconductor laser having a wavelength of about 440 nm (Presentation by Nichia Corporation at the 48th Meeting of the Japan Society of Applied Physics and Related Societies, March, 2001), a green laser having a wavelength of about 530 nm obtained by performing wavelength conversion on a semiconductor laser(oscillation wavelength: about 1060 nm) by allowing it to pass through SHG crystal of $LiNbO_3$ having a domain inversion structure in waveguide form and a red semiconductor laser having a wavelength of about 650 nm (trade name: HITACHI TYPE NO. HL6501MG; manufactured by Hitachi, Ltd.) were used. Each of the above-described laser light of three colors was transferred perpendicularly to a scanning direction by a polygon mirror such that the laser light can perform scanning exposure on the sample in order. Light quantity variance was suppressed by utilizing a peltiert device such that a constant temperature is allowed to be held. An effective beam diameter was 80 μm, a scanning pitch was 42.3 μm (600 dpi) and an average exposure time was $1.7\times10^{-7}$ second. By adopting such exposure method as described above, gradation exposure for gray color forming for the purpose of sensitometry was realized.

Each sample thus exposed was subjected to a super rapid processing comprising color-forming development processing described below.

Processing

Samples of the above-described photosensitive material were processed in a roll form having a width of 127 mm and, then, was subjected to an imagewise exposure through a negative film having an average density by using a prototype processing apparatus which is a remodeled type of a minilab-printer/processor (trade name: PP350; manufactured by Fuji Photo Film Co., Ltd.) and, thereafter, subjected to a running test until replenishments used in processing steps described below reach 0.5 time the capacity of a color-forming development tank.

| Processing steps | Temperature | Time | Replenishment* |
|---|---|---|---|
| Color-forming development | 45.0° C. | 15 second | 45 ml |
| Bleach-fixing | 40.0° C. | 15 second | 35 ml |
| Rinse (1) | 40.0° C. | 8 second | — |
| Rinse (2) | 40.0° C. | 8 second | — |
| Rinse (3) | **40.0° C. | 8 second | — |

-continued

| Processing steps | Temperature | Time | Replenishment* |
|---|---|---|---|
| Rinse (4) | 38.0° C. | 8 second | 121 ml |
| Drying | 80.0° C. | 15 second | |

(Note)
*Replenishment per 1 $m^2$ of photosensitive material
**A rinse-cleaning system (trade name: RC50D; manufactured by Fuji Photo Film Co., Ltd.) was attached to a rinse (3) and, then, a rinse solution was taken from the rinse (3) and, thereafter, the thus-taken rinse solution was sent to a reverse osmosis module (RC50D). The resultant infiltrated water therefrom was supplied to a rinse and condensed water was returned to the rinse (3). A pump pressure was adjusted such that an amount of water to be supplied to the reverse osmosis module for infiltration was maintained at from 30 ml/minute to 50 ml/minute and the rinse solution was circulated for 10 hours a day under a temperature control. Rinse was performed by a 4-tank (from tank (1) through tank (4)) counter-current flow system.

Compositions of respective processing solutions are shown below.

| | [Tank solution] | [Replenishing solution] |
|---|---|---|
| [Color-forming developing solution] | | |
| Water | 800 ml | 600 ml |
| Fluorescent whitening agent (FL-1) | 5.0 g | 8.5 g |
| Triisopropanolamine | 8.8 g | 8.8 g |
| Sodium p-toluene sulfonate | 20.0 g | 20.0 g |
| Ethylene diamine tetraacetic acid | 4.0 g | 4.0 g |
| Sodium sulfite | 0.10 g | 0.50 g |
| Potassium chloride | 10.0 g | — |
| Sodium 4,5-dihydroxy-benzene-1,3-disulfonate | 0.50 g | 0.50 g |
| Disodium-N,N-bis(sulfonatoethyl)-hydroxylamine | 8.5 g | 14.5 g |
| 4-amino-3-methyl-N-ethyl-N-(β-methane sulfonamide ethyl)-aniline · 3/2 sulfate · monohydrate | 10.0 g | 22.0 g |
| Calcium carbonate | 26.3 g | 26.3 g |
| Made up to with water | 1000 ml | 1000 ml |
| pH (25° C.; adjusted by sulfuric acid and potassium hydroxide) | 10.35 | 12.6 |
| [Bleach-fixing solution] | | |
| Water | 800 ml | 800 ml |
| Ammonium thiosulfate (750 g/l) | 107 ml | 214 ml |
| Succinic acid | 29.5 g | 59.0 g |
| Ethylene diamine tetraacetic acid iron (III) ammonium | 47.0 g | 94.0 g |
| Ethylene diamine tetraacetic acid | 1.4 g | 2.8 g |
| Nitric acid (67%) | 17.5 g | 35.0 g |
| Imidazole | 14.6 g | 29.2 g |
| Ammonium bisulfite | 16.0 g | 32.0 g |
| Potassium disulfite | 23.1 g | 46.2 g |
| Made up to with water | 1000 ml | 1000 ml |
| pH (25° C.; adjusted by nitric acid and ammonia water) | 6.00 | 6.00 |
| [Rinse solution] | | |
| Sodium chloroisocyanurate | 0.02 g | 0.02 g |
| Deionized water (Electric conductivity: 5 μS/cm or less) | 1000 ml | 1000 ml |
| pH (25° C.) | 6.5 | 6.5 |

Yellow-forming density of each sample after being processed was measured to obtain a characteristic curve of laser exposure. It was found that the sample using the emulsion of the invention has excellent properties in sensitivity and contrast.

Respective structural formulas of compounds which are used in the examples of the invention are shown below.

40:40:20 mixture (molar ratio) of

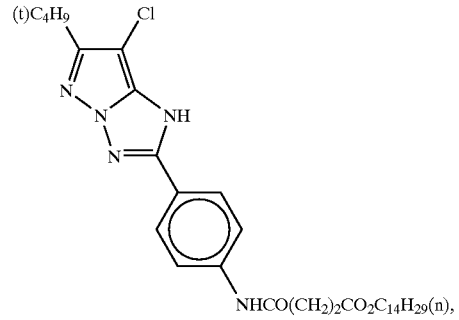

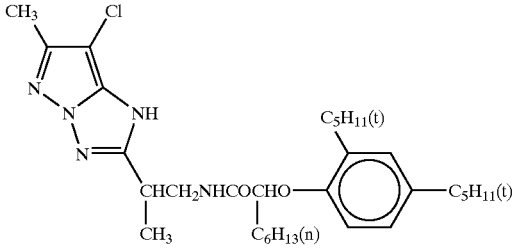

(ExM) Magenta coupler

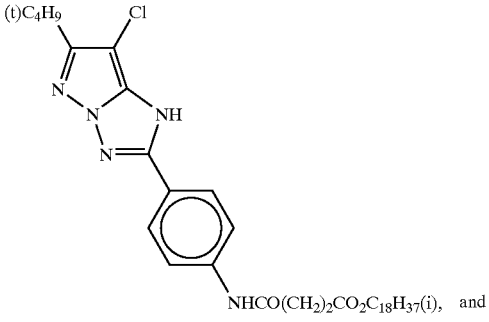

and

-continued
(ExC-2) Cyan coupler
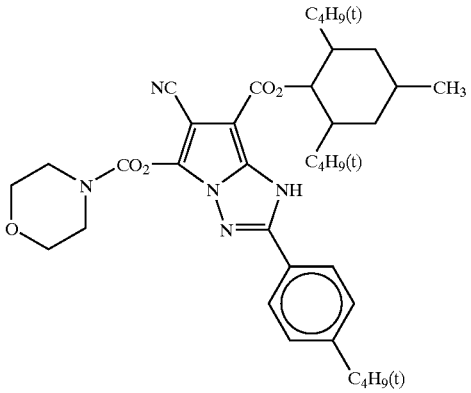
50:25:25 mixture (molar ratio) of
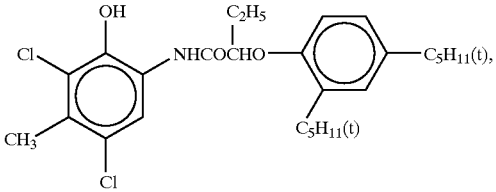
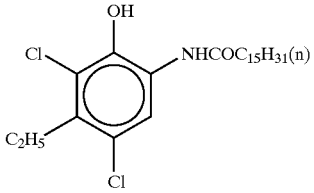
(ExC-3) Cyan coupler
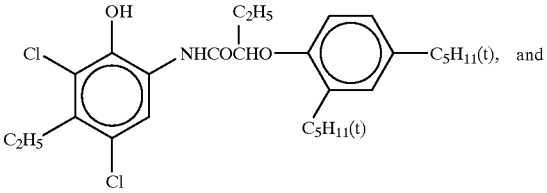
(Cpd-4) Color mixture inhibitor
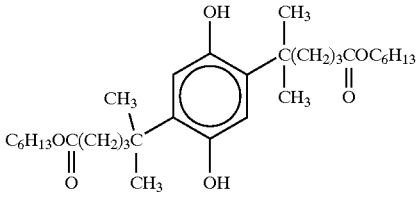
(Cpd-5) Color image stabilizer
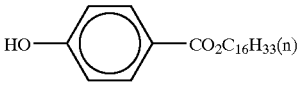
(Cpd-6) Color image stabilizer
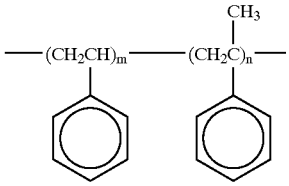
Number average molecular weight: 600
m/n = 10/90
(Cpd-7) Color image stabilizer
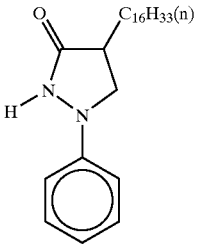
(Cpd-9) Color image stabilizer
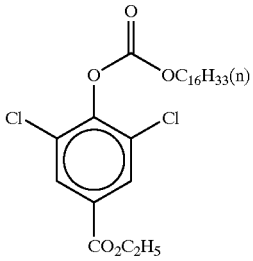
(Cpd-10) Color image stabilizer
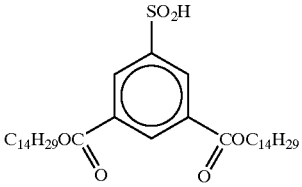

-continued
(Cpd-11)
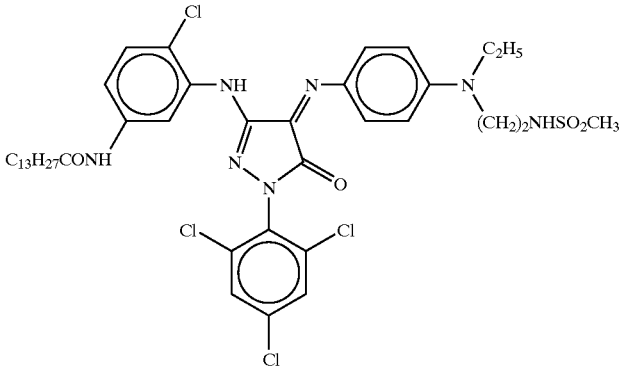
7:3 mixture (molar ratio) of
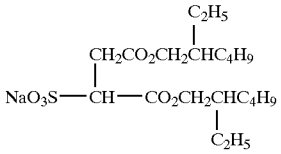
and
(Cpd-13) Surfactant
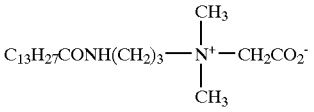
(Cpd-14)
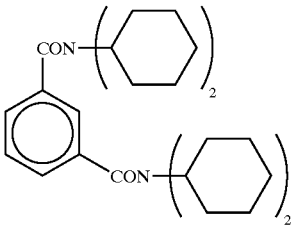
(Cpd-15)
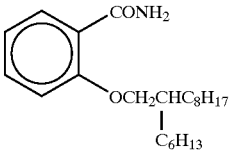
(Cpd-16)
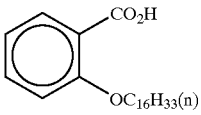
(Cpd-17)
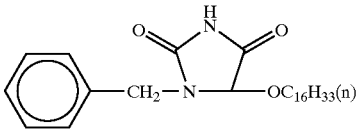
(Cpd-18)
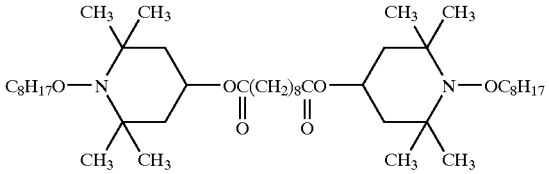
(Cpd-19) Color mixture inhibitor
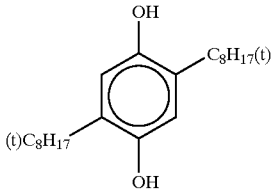
(UV-1) to (UV-7): Ultraviolet ray absorbing agents
(UV-1)
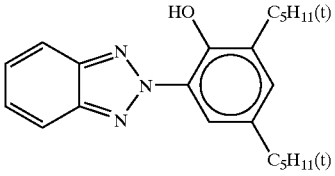
(UV-2)
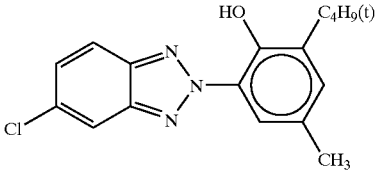

-continued
(UV-3)
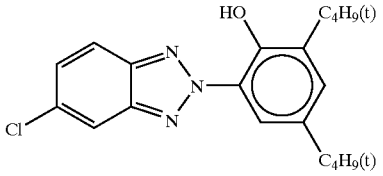
(UV-4)
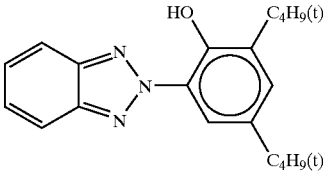
(UV-5)
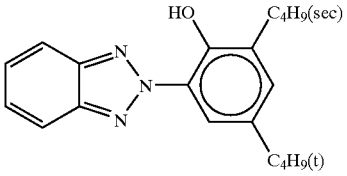
(UV-6)
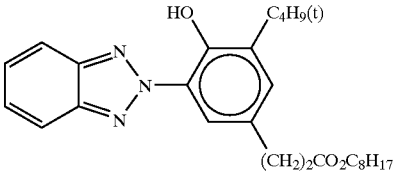
(UV-7)
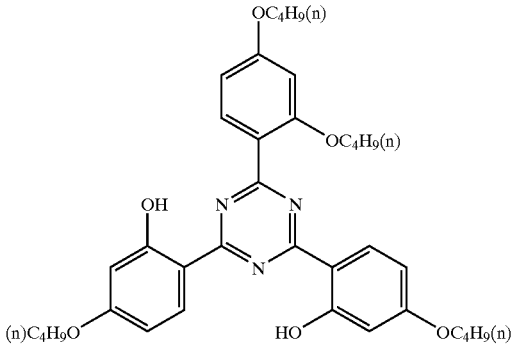
UV-A: Mixture of UV-1/UV-2/UV-3/UV-4 = 4/2/2/3 (weight ratio)
UV-B: Mixture of UV-1/UV-2/UV-3/UV-4/UV-5/UV-6 = 9/3/3/4/5/3 (weight ratio)
UV-C: Mixture of UV-2/UV-3/UV-6/UV-7 = 1/1/1/2 (weight ratio)
(Solv-2)
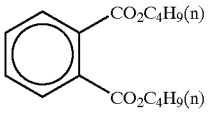
(Solv-3)
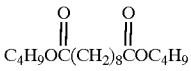
(Solv-4)
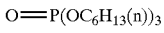
(Solv-5)
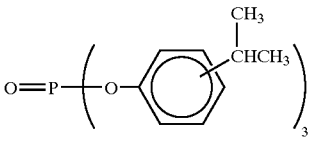
(Solv-7)
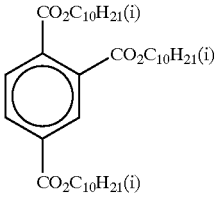
(Solv-8)
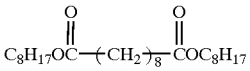

-continued (S1-4)

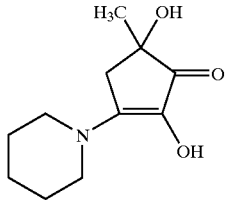

(ExY-2)

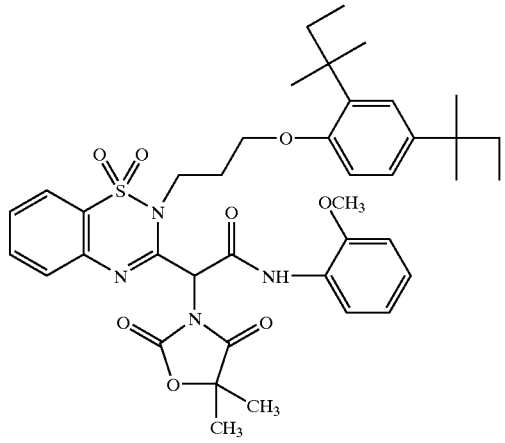

FL-1

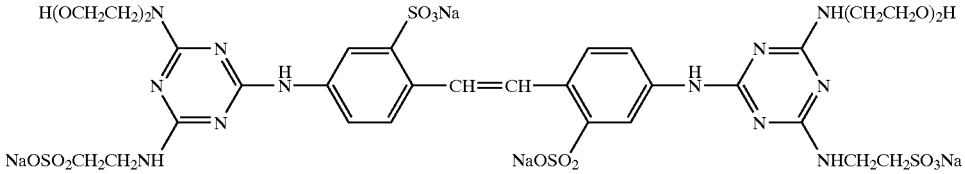

The present invention can provide a silver halide emulsion which is excellent in reciprocity law and has sensitometric characteristics showing high sensitivity and high contrast and a method for producing the silver halide emulsion.

What is claimed is:

1. A silver halide emulsion, comprising: silver halide grains containing silver chloride as a primary component and further containing silver bromide and silver iodide; wherein, when an average value of a silver bromide content of the silver halide grains is represented by Y (mol %), a silver bromide content of at least 68% of the silver halide grains is from 0.82×Y (mol %) to 1.18×Y (mol %) and silver iodide content is 0.05 to 1 mole %.

2. The silver halide emulsion of claim 1, wherein a grain size distribution is no more than 20%.

3. The silver halide emulsion of claim 1, wherein a silver chloride content is at least 95 mol %.

4. The silver halide emulsion of claim 1, wherein the silver halide emulsion comprises a silver bromide-containing phase in which an average Br content is at least 18 mol %.

5. The silver halide emulsion of claim 4, wherein the silver bromide-containing phase includes a layer-shaped structure having a thickness of from 0.005 $\mu$m to 0.04 $\mu$m.

6. The silver halide emulsion of claim 4, wherein an average Br content of the silver bromide-containing phase is from 20 mol % to 32 mol %.

7. The silver halide emulsion of claim 1, wherein at least 50% of a projected area of the grains is trisoctahedral.

8. The silver halide emulsion of claim 4, wherein at least 50% of a projected area of the grains before the silver bromide-containing phase is formed is trisoctahedral.

9. The silver halide emulsion of claim 1, wherein the grains comprise silver iodide in the range of from 0.05 mol % to 0.4 mol %.

10. The silver halide emulsion of claim 4, wherein the grains before the silver bromide-containing phase is formed comprise silver iodide in the range of from 0.05 mol % to 0.4 mol %.

11. A method of producing a silver halide emulsion, comprising the step of reacting at least a silver ion, a chlorine ion and a bromine ion;

wherein a growth speed at a time of forming a silver bromine-containing phase in the reaction process is at least 60% of a critical growth speed; and the silver halide emulsion comprises a silver halide grain containing silver chloride as a primary component and further containing silver bromide, wherein, when an average value of a silver bromide content of the silver halide grain is represented by Y (mol %), a silver bromide content of at least 68% of the silver halide grains is from 0.82×Y (mol %) to 1.18×Y (mol %).

12. The method of producing the silver halide emulsion of claim 11, wherein the growth speed is 70% or more of the critical growth speed.

13. The method of producing the silver halide emulsion of claim 11, wherein a grain size distribution of the silver halide grains is no more than 20%.

14. The method of producing the silver halide emulsion of claim 11, wherein the silver halide grain has a silver chloride content of at least 95 mol %, and the silver halide emulsion further comprises a silver bromide-containing phase wherein an average Br content is at least 18 mol %.

15. The method of producing the silver halide emulsion of claim 14, wherein a temperature at the time of forming the silver bromide-containing phase is no more than 38° C.

16. The siver halide emulsion of claim 1, wherein a siver content of the silver halide grains is at least 95 mole %, and siver bomide content is 1 to 5 mole %.

17. The method of producing the silver halide emulsion of claim 11, wherein the siver halide grains comprise silver iodide in the range of 0.05 to 1 mole %.

18. The method of producing the silver halide emulsion of claim 17, wherein the siver chloride content of the siver halide grains is at least 95 mole %, and the silver bromide content is 1 to 5 mole %.

* * * * *